US012303053B1

(12) United States Patent
Moss et al.

(10) Patent No.: US 12,303,053 B1
(45) Date of Patent: May 20, 2025

(54) SPRING-BIASED END CAPS FOR ROD ASSEMBLY AND METHODS OF USE

(71) Applicant: House of Atlas, LLC, Evanston, IL (US)

(72) Inventors: Jason Moss, Libertyville, IL (US); Matthew Berman, Chicago, IL (US)

(73) Assignee: House of Atlas, LLC, Evanston, IL (US)

( * ) Notice: Subject to any disclaimer, the term of this patent is extended or adjusted under 35 U.S.C. 154(b) by 0 days.

(21) Appl. No.: 18/389,502

(22) Filed: Nov. 14, 2023

(51) Int. Cl.
*A47H 1/02* (2006.01)
*A47H 1/022* (2006.01)

(52) U.S. Cl.
CPC ..... *A47H 1/022* (2013.01)

(58) Field of Classification Search
CPC ..... A47H 1/102; A47H 1/022; A47H 23/00; A47H 2001/0215; F21V 21/13; F21V 33/0016; A47B 96/1425
See application file for complete search history.

(56) References Cited

U.S. PATENT DOCUMENTS

| | | | |
|---|---|---|---|
| 424,610 | A | 4/1890 | Laurence |
| 468,987 | A | 2/1892 | Fowler |
| 519,840 | A | 5/1894 | Edsall |
| 666,467 | A | 1/1901 | Clark |
| 938,883 | A | 11/1909 | Maier |
| 961,352 | A | 6/1910 | Walters |
| 1,062,478 | A | 5/1913 | Kroder |
| 1,374,026 | A | 4/1921 | Nelson |
| 1,401,727 | A | 12/1921 | Pimlott |
| 1,425,247 | A | 8/1922 | Galbreath |
| 1,464,150 | A | 8/1923 | Weyel |
| 1,679,881 | A | 10/1925 | Simpson |

(Continued)

FOREIGN PATENT DOCUMENTS

| | | |
|---|---|---|
| CH | 625601 | 9/1981 |
| DE | 327136 | 10/1920 |

(Continued)

OTHER PUBLICATIONS

Document ID: KR 102212057 B1 to Kim, Won Do; Titled "Height Control Post", Publication date Feb. 4, 2021, see entire document. (Year: 2021).*

(Continued)

*Primary Examiner* — Ko H Chan
(74) *Attorney, Agent, or Firm* — Fitch, Even, Tabin & Flannery LLP

(57) ABSTRACT

A spring-biased end cap for mounting a rod assembly is provided including an outer body, an inner body, and a spring engaging both the outer body and the inner body to change a position of the inner body relative to the outer body upon compression or expansion of the spring. A rod is received within the outer body and fixed to the inner body. In embodiments, the spring has a first end portion connected to the outer body, a second end portion capable of being connected to the inner body to connect the outer body to the inner body, and an intermediate portion extending within a cavity of the outer body. A rod assembly including the spring-biased end cap and a method of mounting a rod assembly using the spring-biased end cap are also provided.

15 Claims, 21 Drawing Sheets

(56) References Cited

U.S. PATENT DOCUMENTS 1,639,551 A 8/1927 Booth
1,742,164 A 12/1929 Berke
1,756,716 A 4/1930 Whitney
1,837,340 A 12/1931 Schwartz
1,910,555 A 5/1933 Marlowe
1,951,660 A 3/1934 Klaudt
2,032,842 A 3/1936 Gould
2,199,851 A 5/1940 Culver
2,275,330 A 3/1942 Tveten
2,293,168 A 8/1942 Pirone
2,325,478 A 7/1943 Collins
2,355,489 A 8/1944 Waddell
2,490,369 A 12/1949 Neuwirth
2,508,039 A 5/1950 Neuwirth
2,542,967 A 2/1951 Waechter
2,637,555 A 5/1953 Klaudt
2,643,143 A 6/1953 Bergqvist
2,661,850 A 12/1953 Fowler et al.
2,695,800 A 11/1954 Soucy
2,696,963 A 12/1954 Shepherd
2,716,533 A 8/1955 Freeman
2,840,402 A 6/1958 Hassel
2,903,141 A 9/1959 Seewack
2,935,299 A 5/1960 Jansen
2,947,556 A 8/1960 Wenger
2,974,806 A 3/1961 Seewack
2,999,706 A 9/1961 Wilcox
3,004,743 A 10/1961 Wenger
3,031,215 A 4/1962 Vance
3,040,902 A 6/1962 Dunn
3,083,041 A 3/1963 Owenmark
3,098,669 A 7/1963 Fortin
3,210,047 A 10/1965 Wilbert
3,227,113 A 1/1966 Kupski
3,333,808 A * 8/1967 Du Boff ..... E04G 25/04
248/200.1
3,424,111 A 1/1969 Maslow
3,515,417 A 6/1970 Bowman
3,559,352 A 2/1971 Magnuson
3,560,032 A 2/1971 Cohen et al.
3,572,511 A 3/1971 Triplett
3,633,862 A 1/1972 Breen
3,674,294 A 7/1972 Kirkham
3,788,489 A 1/1974 Levinthal
3,809,142 A 5/1974 Bleeker
3,851,601 A 12/1974 Davis
3,857,493 A 12/1974 Bourne
3,932,048 A 1/1976 Dupont
3,951,269 A 4/1976 Anderson
3,961,822 A 6/1976 Daniel
4,024,686 A 5/1977 Gronert
4,128,064 A 12/1978 Chung
4,134,703 A 1/1979 Hinners
4,248,418 A 2/1981 Friedberg
4,390,099 A 6/1983 Trautlein
4,405,111 A 9/1983 Lennon
4,419,026 A 12/1983 Leto
4,422,794 A 12/1983 Deken
4,506,477 A 3/1985 Castle
4,629,207 A 12/1986 Shiflet
4,636,106 A 1/1987 Waisbrod
4,653,714 A 3/1987 Andrasko, Jr.
4,700,918 A 10/1987 Andrasko, Jr.
4,757,641 A 7/1988 Penrod
4,765,001 A 8/1988 Smith
4,856,661 A 8/1989 Guillen
4,856,929 A 8/1989 Smahlik
4,895,471 A 1/1990 Geltz
4,991,344 A 2/1991 Carney
4,998,731 A 3/1991 Bowen
5,022,104 A 6/1991 Miller
5,054,624 A 10/1991 Camp
D324,328 S 3/1992 Pagan
5,094,418 A 3/1992 McBarnes, Jr.
D327,421 S 6/1992 Pagan
5,156,281 A 10/1992 Schwartz
5,242,065 A 9/1993 Hoban
5,259,520 A 11/1993 Roggio
5,303,832 A 4/1994 Tu
5,317,855 A 6/1994 De Leeuw
5,330,061 A 7/1994 Geltz
5,333,665 A 8/1994 Safar
5,433,551 A 7/1995 Gordon
5,458,249 A 10/1995 Shang-Lu
5,549,407 A 8/1996 Levi
5,615,721 A 4/1997 Winter
5,653,057 A 8/1997 Gary
5,678,703 A 10/1997 Sawyer
5,681,017 A 10/1997 Clausen
5,702,010 A 12/1997 Liang
5,758,545 A 6/1998 Fevre
D398,468 S 9/1998 Yemini
5,803,643 A 9/1998 Patelli
5,826,847 A 10/1998 Warner
5,881,653 A 3/1999 Pfister
5,894,610 A 4/1999 Winter
5,964,444 A 10/1999 Guertler
5,996,674 A 12/1999 Gatewood
5,996,791 A 12/1999 Bibby
6,010,017 A 1/2000 Michaelis
D421,692 S 3/2000 Wojtowicz
6,062,149 A 5/2000 Duvivier
D429,934 S 8/2000 Hofman
6,213,437 B1 4/2001 Robbins
D443,162 S 6/2001 Winter
D443,813 S 6/2001 Harwanko
6,250,839 B1 6/2001 Lenhart
6,286,282 B1 9/2001 Castano
D450,947 S 11/2001 Walker
6,354,629 B1 3/2002 McNeal
D456,167 S 4/2002 Harwanko
6,443,207 B1 9/2002 Cheng
6,467,989 B1 10/2002 Finkelstein
D466,798 S 12/2002 Rebman
D466,799 S 12/2002 Suero, Jr.
D470,332 S 2/2003 Clucas
6,520,351 B1 2/2003 Zadro
D472,453 S 4/2003 Rebman
6,543,629 B1 4/2003 Samelson
D475,551 S 6/2003 Kelso
D475,561 S 6/2003 Suero, Jr.
D475,562 S 6/2003 Suero, Jr.
6,575,316 B2 6/2003 Lin
6,581,790 B1 6/2003 Zadro
6,637,364 B1 10/2003 Campeau
6,640,867 B1 11/2003 Pallotta
6,651,831 B2 11/2003 Samelson
D483,251 S 12/2003 Suero, Jr.
6,681,831 B1 1/2004 Cheng
D491,448 S 6/2004 Rebman
6,761,202 B1 7/2004 Cheng
D494,052 S 8/2004 Winter
D494,455 S 8/2004 Winter
D494,845 S 8/2004 Winter
6,823,925 B2 11/2004 Militello
6,824,000 B2 11/2004 Samelson
D499,329 S 12/2004 Suero, Jr.
D500,670 S 1/2005 Rebman
6,845,955 B1 1/2005 Hsu
D501,737 S 2/2005 Clucas
D501,738 S 2/2005 Clucas
6,862,776 B2 3/2005 Chen
6,865,817 B2 3/2005 Militello
D504,310 S 4/2005 Harwanko
D504,807 S 5/2005 Harwanko
D505,062 S 5/2005 Suero, Jr.
D505,317 S 5/2005 Harwanko
D507,129 S 7/2005 Harwanko
6,948,545 B1 9/2005 Cheng
6,959,752 B2 11/2005 Huang
6,962,186 B2 11/2005 Hsu
6,966,353 B2 11/2005 Hsu
D513,142 S 12/2005 Suero, Jr.
D513,373 S 1/2006 Harwanko

(56) References Cited

U.S. PATENT DOCUMENTS

| | | | |
|---|---|---|---|
| 6,994,143 | B2 | 2/2006 | McCarty |
| 7,000,521 | B1 | 2/2006 | Cheng |
| 7,000,787 | B2 | 2/2006 | Felsenthal |
| D516,902 | S | 3/2006 | Harwanko |
| D522,844 | S | 6/2006 | Harwanko |
| D522,845 | S | 6/2006 | Suero, Jr. |
| D522,846 | S | 6/2006 | Suero, Jr. |
| D522,847 | S | 6/2006 | Suero, Jr. |
| D525,115 | S | 7/2006 | Harwanko |
| D525,813 | S | 8/2006 | Beasley |
| D526,520 | S | 8/2006 | Clucas |
| D527,246 | S | 8/2006 | Clucas |
| 7,128,124 | B2 | 10/2006 | Bibby |
| 7,147,116 | B1 | 12/2006 | Cape |
| D534,793 | S | 1/2007 | Suero, Jr. |
| D538,571 | S | 3/2007 | Militello |
| D539,064 | S | 3/2007 | Militello |
| 7,194,811 | B2 | 3/2007 | Militello |
| 7,195,051 | B2 | 3/2007 | Nien |
| D542,897 | S | 5/2007 | Harwanko |
| D543,747 | S | 6/2007 | Harwanko |
| D543,748 | S | 6/2007 | Harwanko |
| D544,786 | S | 6/2007 | Barrese |
| D545,180 | S | 6/2007 | Harwanko |
| 7,225,850 | B2 | 6/2007 | McCarty |
| D547,165 | S | 7/2007 | Barrese |
| D547,166 | S | 7/2007 | Barrese |
| D547,167 | S | 7/2007 | Barrese |
| D548,574 | S | 8/2007 | Harwanko |
| 7,255,149 | B2 | 8/2007 | Rossato |
| 7,255,312 | B2 | 8/2007 | Melic |
| 7,264,035 | B2 | 9/2007 | Rossato |
| D562,608 | S | 2/2008 | Kramer |
| D562,609 | S | 2/2008 | Kramer |
| 7,331,370 | B1 | 2/2008 | Militello |
| D563,136 | S | 3/2008 | Kramer |
| D563,138 | S | 3/2008 | Kramer |
| 7,341,230 | B2 | 3/2008 | Beaudry |
| 7,346,940 | B1 | 3/2008 | Liao |
| D566,991 | S | 4/2008 | Harwanko |
| D568,656 | S | 5/2008 | Kramer |
| D569,149 | S | 5/2008 | Walker |
| D569,668 | S | 5/2008 | Kramer |
| D571,136 | S | 6/2008 | Kramer |
| D573,386 | S | 7/2008 | Clucas |
| D573,387 | S | 7/2008 | Walker |
| D576,475 | S | 9/2008 | Didehvar |
| D576,476 | S | 9/2008 | Didehvar |
| D586,647 | S | 2/2009 | Didehvar |
| 7,510,152 | B2 | 3/2009 | Melic |
| D591,142 | S | 4/2009 | Cittadino |
| 7,549,615 | B2 | 6/2009 | Shevick |
| 7,562,689 | B1 | 7/2009 | Militello |
| 7,600,549 | B2 | 10/2009 | Cheng |
| 7,641,161 | B2 | 1/2010 | Bauer |
| 7,658,154 | B2 | 2/2010 | Yankello |
| 7,665,500 | B2 | 2/2010 | Rossato |
| 7,699,276 | B2 | 4/2010 | Melic |
| 7,726,898 | B2 | 6/2010 | Lenhart |
| 7,819,166 | B2 | 10/2010 | Militello |
| D628,000 | S | 11/2010 | Lindo |
| 7,857,151 | B2 | 12/2010 | Barrese |
| D632,513 | S | 2/2011 | Cittadino |
| D632,514 | S | 2/2011 | Didehvar |
| D632,515 | S | 2/2011 | Cittadino |
| 7,877,824 | B2 | 2/2011 | Grant |
| D633,780 | S | 3/2011 | Barrese |
| D635,807 | S | 4/2011 | Lindo |
| 7,926,127 | B2 | 4/2011 | Barrese |
| 7,931,160 | B2 | 4/2011 | Newbouild |
| D640,488 | S | 6/2011 | Didehvar |
| D641,190 | S | 7/2011 | Cittadino |
| D641,191 | S | 7/2011 | Walker |
| D641,193 | S | 7/2011 | Vaccaro |
| D641,194 | S | 7/2011 | Vaccaro |
| 7,984,814 | B2 | 7/2011 | Didehvar |
| D643,236 | S | 8/2011 | Cittadino |
| D643,657 | S | 8/2011 | Cittadino |
| D644,050 | S | 8/2011 | Cittadino |
| 7,997,428 | B2 | 8/2011 | Goldstein |
| D647,391 | S | 10/2011 | Barrese |
| D648,969 | S | 11/2011 | Cittadino |
| D649,352 | S | 11/2011 | Cittadino |
| 8,052,110 | B2 | 11/2011 | Wang |
| 8,056,873 | B1 | 11/2011 | Hanely |
| D650,263 | S | 12/2011 | Barrese |
| 8,069,507 | B2 | 12/2011 | Didehvar |
| 8,069,632 | B2 | 12/2011 | Li |
| 8,069,999 | B2 | 12/2011 | Kaveh |
| D652,236 | S | 1/2012 | Walker |
| D652,237 | S | 1/2012 | Cittadino |
| D653,067 | S | 1/2012 | Cittadino |
| 8,104,729 | B2 | 1/2012 | Walke |
| 8,113,361 | B2 | 2/2012 | Winter |
| 8,152,118 | B2 | 4/2012 | Melic |
| 8,157,111 | B2 | 4/2012 | Didehvar |
| D660,064 | S | 5/2012 | Webb |
| D660,065 | S | 5/2012 | Webb |
| D660,066 | S | 5/2012 | Webb |
| 8,166,583 | B1 | 5/2012 | Liang |
| 8,185,981 | B2 | 5/2012 | Didehvar |
| D661,529 | S | 6/2012 | Cittadino |
| D661,927 | S | 6/2012 | Cittadino |
| D664,423 | S | 7/2012 | Cittadino |
| D664,424 | S | 7/2012 | Cittadino |
| 8,214,938 | B2 | 7/2012 | Hanley |
| 8,215,501 | B2 | 7/2012 | Trettin |
| 8,215,863 | B2 | 7/2012 | Sohn |
| 8,225,946 | B2 | 7/2012 | Yang |
| D666,012 | S | 8/2012 | Walker |
| D667,246 | S | 9/2012 | Cittadino |
| D667,295 | S | 9/2012 | Harwanko |
| 8,297,870 | B2 | 10/2012 | Lenhart |
| D670,521 | S | 11/2012 | Cittadino |
| D670,522 | S | 11/2012 | Cittadino |
| D670,944 | S | 11/2012 | Cittadino |
| D671,347 | S | 11/2012 | Cittadino |
| D671,348 | S | 11/2012 | Cittadino |
| D671,395 | S | 11/2012 | Harwanko |
| 8,302,919 | B1 | 11/2012 | McGrath |
| D672,178 | S | 12/2012 | Walker |
| D672,990 | S | 12/2012 | Lindo |
| D672,991 | S | 12/2012 | Cittadino |
| 8,341,775 | B2 | 1/2013 | Didehvar |
| 8,347,936 | B2 | 1/2013 | Martin |
| 8,348,072 | B2 | 1/2013 | Whitehall |
| 8,403,430 | B2 | 3/2013 | Atkins |
| 8,408,405 | B2 | 4/2013 | Yang |
| D681,422 | S | 5/2013 | Lindo |
| D681,423 | S | 5/2013 | Walker |
| D684,037 | S | 6/2013 | Harwanko |
| 8,479,932 | B2 | 7/2013 | Carney |
| 8,491,568 | B2 | 7/2013 | Schertiger |
| 8,500,357 | B2 | 8/2013 | Stahle |
| 8,505,129 | B2 | 8/2013 | Parker |
| 8,505,749 | B2 | 8/2013 | Trettin |
| 8,506,200 | B2 | 8/2013 | Lu |
| D691,029 | S | 10/2013 | Didehvar |
| D691,030 | S | 10/2013 | Lindo |
| D691,031 | S | 10/2013 | Harwanko |
| 8,544,661 | B1 | 10/2013 | Melino, Sr. |
| 8,561,667 | B1 | 10/2013 | Hanley |
| D693,209 | S | 11/2013 | Walker |
| 8,573,416 | B2 | 11/2013 | Didehvar |
| 8,578,995 | B2 | 11/2013 | Nelson |
| 8,585,160 | B2 | 11/2013 | Atkins |
| D696,573 | S | 12/2013 | Didehvar |
| 8,616,138 | B1 | 12/2013 | Fu |
| D702,112 | S | 4/2014 | Cittadino |
| 8,696,229 | B2 | 4/2014 | Tran |
| 8,763,821 | B2 | 7/2014 | Yang |
| 8,763,822 | B2 | 7/2014 | Didehvar |
| 8,807,513 | B2 | 8/2014 | Volin |
| 8,814,114 | B2 | 8/2014 | Baines |

(56) References Cited

U.S. PATENT DOCUMENTS 8,827,587 B2 9/2014 Didehvar
8,839,980 B2 9/2014 Baines
D714,571 S 10/2014 Walker
8,851,305 B2 10/2014 Didehvar
8,851,435 B1 10/2014 Bastien
8,869,999 B2 10/2014 Lindo
8,875,770 B1 11/2014 Martin
8,925,747 B1 * 1/2015 Hanley ..... A47H 1/022 211/105.6
8,960,456 B2 2/2015 Didehvar
8,978,228 B2 3/2015 Didehvar
9,009,878 B2 4/2015 Baines
9,021,627 B2 5/2015 Parker
9,033,163 B2 5/2015 Hsu
9,066,637 B2 6/2015 Zeng
9,107,495 B2 8/2015 Lindo
9,107,496 B2 8/2015 Lindo
9,107,529 B2 8/2015 Didehvar
9,107,544 B2 8/2015 Cittadino
9,131,795 B2 9/2015 Didehvar
9,161,664 B2 10/2015 Zeng
9,181,967 B2 11/2015 Lim
9,194,415 B2 11/2015 Ou
9,204,764 B1 12/2015 Hanley
D746,667 S 1/2016 Vaccaro
9,271,592 B2 3/2016 Didehvar
9,339,151 B2 5/2016 Yang
9,357,860 B1 6/2016 Klowan
9,388,837 B1 7/2016 Hanley
9,468,294 B2 10/2016 Fu
9,474,421 B2 10/2016 Baines
9,480,314 B2 11/2016 Heim
9,578,995 B2 2/2017 Hanley
9,693,660 B1 7/2017 Stelmarski
9,770,110 B1 9/2017 Biggs
9,770,138 B2 9/2017 Engell
9,808,125 B2 11/2017 Jepson
9,883,742 B2 2/2018 Yang
9,943,192 B2 4/2018 Yang
9,999,322 B2 6/2018 Hain
10,016,077 B1 7/2018 Carney
10,034,587 B1 7/2018 Elliot
10,047,787 B2 8/2018 Cheng
10,064,523 B2 9/2018 Engell
10,070,748 B2 9/2018 Hanley
10,092,126 B2 10/2018 Baines
10,278,529 B2 5/2019 Baines
10,422,470 B2 9/2019 Cote
10,426,287 B1 * 10/2019 Tsai ..... A47H 1/022
10,463,199 B2 11/2019 Coratolo
10,485,383 B2 11/2019 Worden, IV
10,595,683 B1 3/2020 Stelmarski
10,612,576 B2 4/2020 Hanley
10,743,700 B1 * 8/2020 Sayed ..... A47H 1/142
10,758,091 B2 9/2020 Engell
10,786,105 B2 9/2020 Scanlon
10,844,890 B2 11/2020 Daniels
10,925,403 B1 2/2021 Su
10,959,559 B2 3/2021 Moss
10,995,786 B2 5/2021 Didehvar
11,116,324 B2 9/2021 Leng
11,154,150 B2 10/2021 Cohn
11,382,447 B2 7/2022 Berman
11,825,940 B2 11/2023 Berman
11,974,704 B2 5/2024 Berman
2002/0158033 A1 10/2002 Chen
2003/0209509 A1 11/2003 Felsenthal
2004/0182806 A1 9/2004 Figueroa
2004/0228704 A1 11/2004 Rotshtain
2005/0263655 A1 12/2005 Bauer
2006/0156465 A1 7/2006 Lavi
2006/0204322 A1 9/2006 Roiser
2007/0170134 A1 7/2007 Bishop
2008/0163418 A1 7/2008 Barrese
2008/0272252 A1 * 11/2008 Conde ..... A01G 9/023 248/146
2009/0184078 A1 7/2009 Lee
2009/0223642 A1 9/2009 Militello
2009/0223917 A1 9/2009 Grant
2010/0206492 A1 8/2010 Shevick
2010/0310306 A1 12/2010 Wright
2010/0316438 A1 12/2010 Sohn
2011/0226925 A1 9/2011 Tsai
2011/0284484 A1 11/2011 Lin
2011/0297632 A1 12/2011 Goldstein
2012/0005823 A1 1/2012 Baines
2012/0017366 A1 1/2012 Barrese
2012/0103924 A1 5/2012 Chuang
2012/0152872 A1 6/2012 Didehvar
2012/0152873 A1 6/2012 Didehvar
2012/0152874 A1 6/2012 Didehvar
2012/0217215 A1 8/2012 Emery
2012/0241399 A1 9/2012 Trettin
2012/0284914 A1 11/2012 Bauer
2012/0285914 A1 11/2012 Carney
2013/0045041 A1 2/2013 Sohn
2013/0047331 A1 2/2013 Parker
2013/0112639 A1 5/2013 Baines
2013/0198948 A1 8/2013 Zeng
2013/0198949 A1 8/2013 Hai
2013/0200024 A1 8/2013 Lindo
2013/0306828 A1 11/2013 Volin
2013/0334156 A1 12/2013 Baines
2013/0341474 A1 12/2013 Baines
2014/0124598 A1 5/2014 Vaccaro
2014/0130331 A1 5/2014 Didehvar
2014/0131298 A1 5/2014 Didehvar
2014/0131299 A1 5/2014 Didehvar
2014/0166603 A1 6/2014 Baines
2014/0224754 A1 8/2014 Baines
2014/0263123 A1 9/2014 Ford
2014/0360959 A1 12/2014 Didehvar
2014/0360960 A1 12/2014 Didehvar
2015/0034581 A1 2/2015 Hsu
2015/0265086 A1 9/2015 Hanley
2015/0285286 A1 10/2015 Sanford
2015/0297038 A1 10/2015 Vaccaro
2016/0113447 A1 4/2016 Walker
2016/0206126 A1 7/2016 Ford
2016/0374518 A1 12/2016 Baines
2017/0360261 A1 12/2017 Coratolo
2018/0008101 A1 1/2018 Engell
2018/0014680 A1 1/2018 Hanley
2018/0020880 A1 1/2018 Patterson
2018/0051739 A1 2/2018 Cheng
2018/0064279 A1 3/2018 Hanley
2018/0098656 A1 4/2018 Baines
2018/0296018 A1 10/2018 Baines
2018/0306219 A1 10/2018 Hanley
2019/0082875 A1 3/2019 Scanlon
2019/0099034 A1 4/2019 Hanley
2020/0281389 A1 * 9/2020 Moss ..... A47H 1/022
2021/0030187 A1 2/2021 Berman
2021/0177183 A1 6/2021 Moss
2021/0244200 A1 8/2021 Webb
2021/0353053 A1 11/2021 Berman
2022/0160158 A1 5/2022 Scanlon
2022/0225762 A1 7/2022 Berman
2022/0265075 A1 8/2022 Berman
2023/0157473 A1 5/2023 Jason
2023/0180957 A1 6/2023 Liu
2023/0337846 A1 10/2023 Moss
2023/0404310 A1 12/2023 Berman
2025/0064245 A1 2/2025 Berman et al.

FOREIGN PATENT DOCUMENTS

DE 1046998 12/1958
DE 3518106 11/1986
DE 29720821 2/1998
DE 29807681 7/1998
DE 102008036149 6/2010
DE 202019106467 12/2019

(56) References Cited

FOREIGN PATENT DOCUMENTS

| | | |
|---|---|---|
| EP | 0314357 | 5/1989 |
| EP | 2113674 | 11/2009 |
| FR | 382527 | 2/1908 |
| FR | 474169 | 2/1915 |
| FR | 718486 | 1/1932 |
| WO | 2016122378 | 8/2016 |

OTHER PUBLICATIONS

Document ID: KR 101505001 B1 to Jeon, Jae Kwon; Titled "Shelf Post Function of Length Control", Publication date Mar. 23, 2015, see entire document (Year: 2015).*
Document ID: KR 20160084956 A to Yoon, Hee Jun et al.; Titled "Support for Dish Shelf", Publication date Jul. 15, 2016, see entire document (Year: 2016).*
Document ID: KR 20110006727 U to 박봉오 Titled "Shelf Post for kitchen with function of length control"; Publication date Jul. 6, 2011 (Year: 2011).*
Document ID: KR 20030004261 A to Lee, Jong Hwa; Publication date: Jan. 14, 2003 (Year: 2003).*
Document ID: CN102641070A o Li, X; Titled "Supporting Rod E.g. Special-shaped Column Rod, for Mounting Commodity Shelf, Has Conical Sleeve Pressed to Outer Part of Conical Surface of Conical Sleeve Inner Side on Outer Wall of Inner Sleeve Rod So as to Lock In", Publication Date:: Aug. 22, 2012 (Year: 2012).*
Document ID: CA 2638496 A1 to Asada, H et al Titled "Pole for Shelving/storage System, Has Lower Shoe Threaded to Bottom of Pole Body, Where Distance From Bottom of Lower Shoe to Bottom of Pole Body is Adjustable Through One Range of Movement . . . ", Publication date Feb. 3, 2009, see entire document. (Year: 2009).*
Artika Shower Caddy—Odyssey 2 Instruction Manual (PO-22046), Publicly available for purchase before May 18, 2020, 5 pages.
Artika Tension Shower Caddy with Mirror in Aluminum, <https://www.homedepot.com/p/ARTIKA-Tension-Shower-Caddy-with-Mirror-in-Aluminum-ATL58-C1/302023780>, Publicly available for purchase before May 18, 2020, 2 pages.
Better Homes & Gardens Tension Pole Shower Caddy, <https://www.walmart.com/ip/Better-Homes-Gardens-Tension-Pole-Shower-Caddy-Oil-Rubbed-Bronze/900634206>, Publicly available for purchase before May 18, 2020, 3 pages.
Better Homes & Gardens, Model 2147HBWM (Oil Rubbed Bronze) Instruction Manual, Dec. 13, 2017, 10 pages.
Glacier Bay L Style Tension Pole Shower Caddy in Bronze with 4-Shelves (1002928650), <https://www.homedepot.com/p/Glacier-Bay-L-Style-Tension-Pole-Shower-Caddy-in-Bronze-with-4-Shelves-2130HBHD/303838532?NCNI-5>, Publicly available for purchase before May 18, 2020, 3 pages.
Glacier Bay Rustproof Tension Pole Shower Caddy in Satin Chrome (1002928717), <https://www.homedepot.com/p/Glacier-Bay-Rustproof-Tension-Pole-Shower-Caddy-in-Satin-Chrome-2141ALHD/303880494>, Publicly available for purchase before May 18, 2020, 2 pages.
Ikea Botaren Shower Curtain Tension rod Assembly Manual, Publically available for purchase before Jun. 15, 2023, 4 pages.
InterDesign 4 Tier Tension Caddy, <https://www.kohls.com/product/prd-3451054/interdesign-4-tier-tension-caddy.jsp>, Publicly available for purchase before May 18, 2020, 1 page.
Kenney Gray 4-Tier Tension Pole Shower Caddy, <https://www.biglots.com/product/gray-4-tier-tension-pole-shower-caddy/p810196875>, Publicly available for purchase before May 18, 2020, 2 pages.
Kenney Instruction Manual, Kenney Manufacturing Company, Publicly available for purchase before May 18, 2020, 4 pages.
Made by Design (Target) Pole Caddy Instruction Manual, Style #91830 (Aluminum), 2019, 17 pages.
Made by Design L-Shaped Tension Pole Caddy Chrome, <https://www.target.com/p/steel-l-shaped-tension-pole-caddy-chrome-made-by-design-8482/-/A-54154453#Ink=sametab>, Publicly available for purchase before May 18, 2020, 3 pages.
Made by Design Rustproof Aluminum Tension Pole Caddy Chrome, <https://www.target.com/p/rustproof-aluminum-tension-pole-caddy-chrome-made-by-design-8482/-/A-54154994#Ink=sametab> Publicly available for purchase before May 18, 2020, 3 pages.
Made by Design Steel Corner Pole Caddy, <https://www.target.com/p/steel-corner-pole-caddy-made-by-design-153/-/A-54513380?preselect=54149567#Ink=sametab>, Publicly available for purchase before May 18, 2020, 3 pages.
Mainstays Tension Pole Shower Caddy, <https://www.walmart.com/ip/Mainstays-Tension-Pole-Shower-Caddy-Chrome/700323962>, Publicly available for purchase before May 18, 2020, 2 pages.
Mainstays, 3-Tier Tension Pole Shower Caddy, <https://www.walmart.com/ip/Mainstays-3-Tier-Tension-Pole-Shower-Caddy-Satin-Nickel/634266997>, Publicly available for purchase before May 18, 2020, 3 pages.
Org 3-Tier Pole Caddy, <https://www.bedbathandbeyond.com/store/product/org-3-tier-pole-caddy/3317048?keyword=org-shower-caddy>, Publicly available for purchase before May 18, 2020, 2 pages.
Oxo 4-Tier Anodized Aluminum Tension Pole Shower Caddy, <https://www.bedbathandbeyond.com/store/product/oxo-4-tier-anodized-aluminum-tension-pole-shower-caddy/5193005>, Publicly available for purchase before May 18, 2020, 2 pages.
Oxo Good Grips Quick-Extend Aluminum Pole Caddy (13241500) Instruction Manual, Oxo Good Grips, Publicly available for purchase before May 18, 2020, 2 pages.
Photographs of end cap by Zenith Products Corporation, publicly available before Mar. 8, 2019 (5 pages).
Picture of Ikea Botaren Shower Curtain Tension rod, Publically available for purchase before Jun. 15, 2023.
Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.
Product 1—Pictures of an Adjustable Rod, publicly available before Mar. 8, 2019, 1 page.
Product 2—Pictures of an Adjustable Rod, publicly available before Mar. 8, 2019, 1 page.
Product 3—Pictures of an Adjustable Rod, publicly available before Mar. 8, 2019, 1 page.
Product 4—Pictures of an Adjustable Rod, publicly available before Mar. 8, 2019, 2 pages.
Product 5—Pictures of an Adjustable Rod, publicly available before Mar. 8, 2019, 1 page.
Product 6—Pictures of an Adjustable Rod, publicly available before Mar. 8, 2019, 1 page.
Product 7—Pictures of an Adjustable Rod, publicly available before Mar. 8, 2019, 2 pages.
Salt Steel 3-Tier Pole Shower Caddy in Sterling, <https://www.bedbathandbeyond.com/store/product/salt-steel-3-tier-pole-shower-caddy-in-sterling/5023377?keyword=salt-shower-caddy>, Publicly available for purchase before May 18, 2020, 2 pages.
SimpleHuman Stainless Steel Tension Pole Shower Caddy, <https://www.containerstore.com/s/bath/shower-bathtub/simplehuman-stainless-steel-tension-pole-shower-caddy/12d?productId=10028454&gclid=CjwKCAiAgc-ABhA7EiwAjev-j2IPg4hrYI4NADnrmdkkIYKinu_0IYYHUbHezs4dVsjeVL2-kaSQSBoCjdcQAvD_BwE>, Publicly available for purchase before May 18, 2020, 1 pages.
Titan Never Rust Premium Aluminum Tension Caddy in Satin Chrome, <https://www.bedbathandbeyond.com/store/product/titan-reg-never-rust-reg-premium-aluminum-tension-caddy-in-satin-chrome/5049773> Publicly available for purchase before May 18, 2020, 2 pages.
U.S. Appl. No. 16/877,084, entitled "Customizable Shower Caddy," filed Jun. 11, 2020.
Zenna Home Corner Pole Caddy Nickel, <https://www.target.com/p/corner-pole-caddy-nickel-zenna-home/-/A-79196668#Ink=sametab>, Publicly available for purchase before May 18, 2020, 5 pages.
Zenna Home L-Shaped Pole Caddy Nickel, <https://www.target.com/p/l-shaped-pole-caddy-nickel-zenna-home/-/A-79196669#Ink=sametab>, Publicly available for purchase before May 18, 2020, 2 pages.

(56) References Cited

OTHER PUBLICATIONS

Zenna Model 2149PC (Chrome) Instruction Manual, Zenith Products, Dec. 6, 2017, 10 pages.
Photographs of end cap from Room Essentials Tension Rod product, publicly available at least by Mar. 1, 2023, 8 pages.
Photographs of end caps of Mainstays Easy hang Shower Curtain Tension Rod, Adjustable 44"-72", publicly available at least by Mar. 1, 2023, 5 pages.

* cited by examiner

SPRING-BIASED END CAPS FOR ROD ASSEMBLY AND METHODS OF USE

FIELD

This disclosure relates to support rods, and, more particularly, end caps for support rods.

BACKGROUND

Support rods are used horizontally to support shower curtains or drapery. They also are used vertically to hold baskets and other items. One common vertical use is a shower caddy. Typical support rods are adjustable and include an outer rod and an inner rod that slides telescopically in and out of the outer rod to adjust the overall length of the rods. A lock mechanism secures the outer and inner rods together when adjusted to the desired length.

Adjustable end caps can also be used with support rods to help secure the rods between their opposing support surfaces, such as walls. There is a need to improve adjustable end cap systems to simplify construction and use of the end caps.

DETAILED DESCRIPTION

Figure 1:
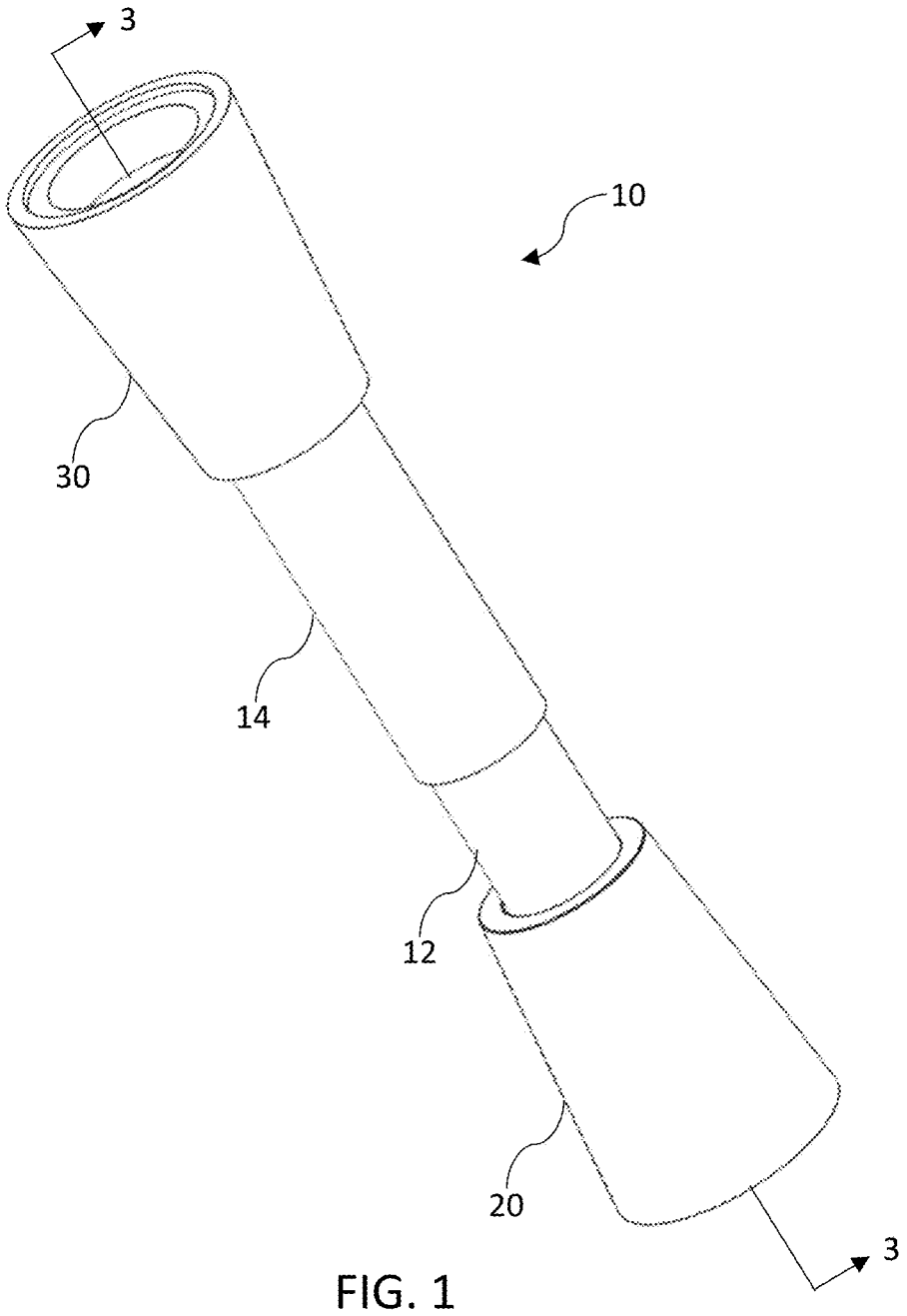
FIG. 1 is a perspective view of a rod assembly according to a first embodiment.

With reference to FIG. 1, there is illustrated a rod assembly 10 with a hollow, inner rod 12 and a hollow, outer rod 14. The inner rod 12 is telescopically received in the outer rod 14 to adjust the overall length of the rod assembly 10. A lock mechanism (not shown) may be included to secure the inner rod 12 and the outer rod 14 together when adjusted to the desired length. The lock mechanism may include the lock mechanisms described in U.S. Pat. Nos. 10,959,559, 11,382,447, and U.S. Publication No. 2023/0277012, all of which are incorporated by reference herein in their entireties.

An end of the outer rod 14 is fitted with a first spring-biased end cap 30. An end of the inner rod 12 is fitted with a second end cap 20 that may or may not be spring-biased. The end caps 30, 20 engage opposing support surfaces.

In use, the spring-biased end cap 30 adjusts to provide sufficient tension between the rod assembly 10 and the opposing support surfaces so that the rod assembly 10 is securely held between the opposing support surfaces.

With reference to FIGS. 2-6, the spring-biased end cap 30 includes an outer body 32, an inner body or insert 34, and a spring 36. The inner body 34 is at least partially received within a cavity 46 of the outer body 32 and is movably coupled to the outer body 32 via the spring 36. Specifically, the spring 36 may be a helical compression spring and has a first end 37 couplable or coupled to the outer body 32 and a second end 38 couplable or coupled to the inner body 34 to thereby secure the outer body 32 to the inner body 34. An intermediate portion 39 of the spring 36 extends through the cavity 46 of the outer body 32 and permits displacement or a change of position of the inner body 34 and the outer body 32 relative to one another when the spring 36 compresses or expands.

With reference to FIGS. 3 and 6-8, the outer body 32 has an inboard end 42 for receiving the inner body 34 and the outer rod 14 (or the inner rod 12 in some configurations) and an outboard end 44 for engaging the support surface. The outer body 32 has a frustoconical outer profile, with the outer diameter of an outer wall 40 of the outer body 32 increasing from the inboard end 42 to the outboard end 44. In other configurations, the outer body 32 may be generally cylindrical or have other geometries (e.g., bell-shaped).

The inboard end 42 defines an opening and the hollow interior or cavity 46 which receives the inner body 34, the outer rod 14, and the spring 36. The cavity 46 may have a shape (e.g., frustoconical) generally corresponding to the outer profile of the outer body 32 at the inboard end 42. For example, an inner diameter of the cavity 46 may gradually increase from the inboard end 42 towards the outboard end 44. In other configurations, the cavity 46 may be substantially cylindrical with a uniform inner diameter. The cavity 46, as described further below, is dimensioned to receive and permit movement or displacement of the inner body 34, spring 36, and outer rod 14 relative to the outer body 32 so that the rod assembly 10 can adjust to an appropriate length to hold the rod assembly 10 in tension between opposing support surfaces.

The outer body 32 includes a lateral annular wall 50 extending radially inward from the outer wall 40. The lateral annular wall 50 provides a partial floor or inner boundary to the cavity 46 and defines a passage 52 therethrough. The passage 52 is open to the cavity 46 and is sized to securely receive a first end portion 37 of the spring 36. The passage 52 includes one or more internal grooves 54 sized and configured to engage and retain one or more coils of the spring 36. For instance, in one form the one or more grooves 54 define internal helical threading of the passage 52 to engage and retain the coils of the spring 36. The threading may be partial, discontinuous threading or may be continuous threading.

The grooves or threading 54 of the passage 52 may, for example, engage at least one coil of the spring 36, at least two coils of the spring 36, or three or more coils of the spring 36. The coils of the spring 36 may be retained by the grooves or threading 54 such that the retained coils, in use, are held from at least substantial translation within or out of the passage 52. In some embodiments, the grooves or threading 54 retain the coils so that compression or expansion of the retained coils is reduced or inhibited. In some embodiments, the coils are retained by the grooves or threading 54 to permit some compression or expansion, though at an amount that is less than the compression or expansion of the unretained coils of the intermediate portion 39 of the spring 36.

Retaining the first end portion 37 of the spring 36 in this manner supports, stabilizes, and positions the spring 36, and allows the spring 36 to thereby support, stabilize, and position the inner body 34 and the outer rod 14. Specifically, the passage 52 maintains the spring 36 along a central longitudinal axis Y of the outer body 32 and in a position substantially perpendicular to the inboard end 42 and the outboard end 44 and the mounting surfaces. In addition, this configuration keeps the spring 36 and the inner body 34 from becoming dislodged from the outer body 32 or falling out in both use, storage, and/or transportation of the rod assembly 10.

The passage 52 may be open to the outboard end 44 of the outer body 32. As illustrated, for instance, the passage 52 may extend continuously from a cavity 48 at the outboard end 44 to the cavity 46 at the inboard end 42. In this configuration, the cavity 48, passage 52, and cavity 46 may constitute a through-opening extending the entire length of the outer body 32. The cavity 48, in certain embodiments, allows the spring 36 to be adjusted further in the outboard direction if needed. For instance, springs of varying length and/or varying spring constants can be interchanged and used with the rod assembly 36 and adjusted so that the intermediate portion 39 of the spring 36 extending freely within the cavity 46 between the passage 52 and the inner body 34 extend an appropriate distance to provide suitable spring force and tension during mounting.

Figure 6:
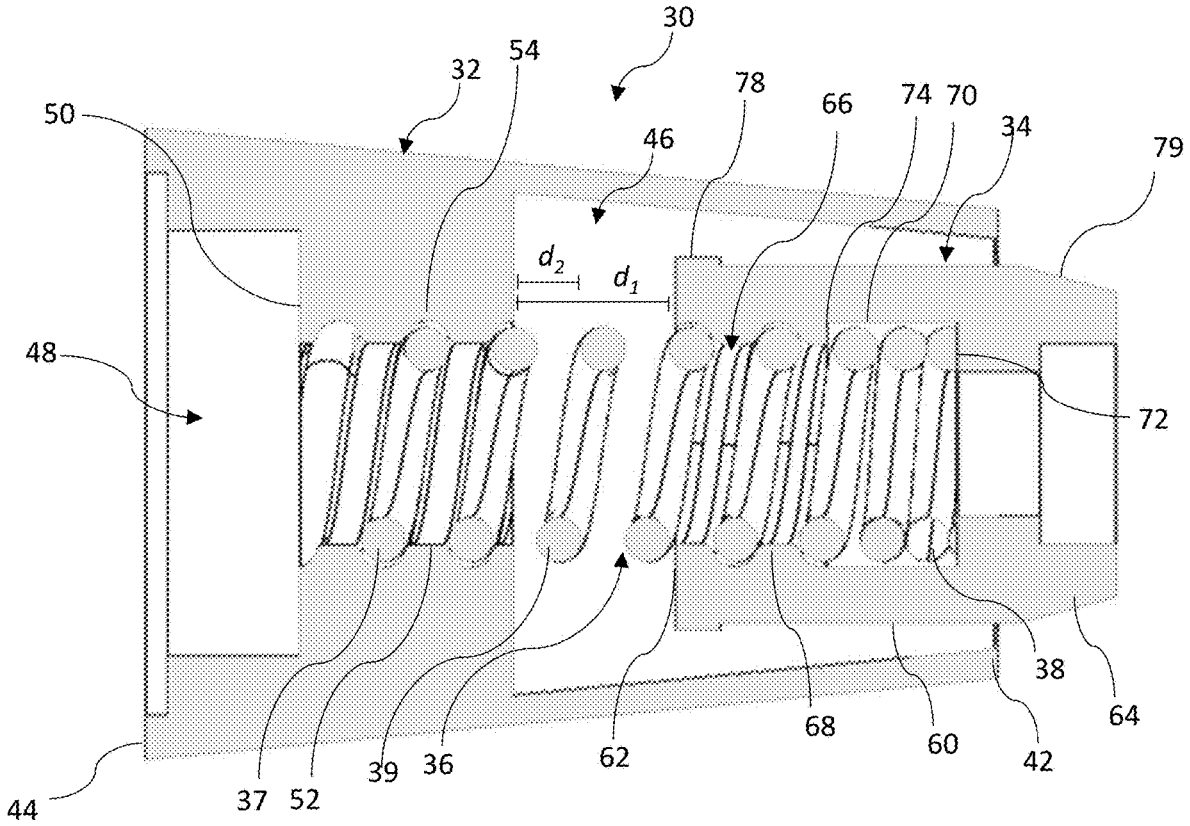
FIG. 6 is a cross-sectional view of the spring-biased end cap of FIG. 4 taken along line 6-6 of FIG. 4.
Figure 7:
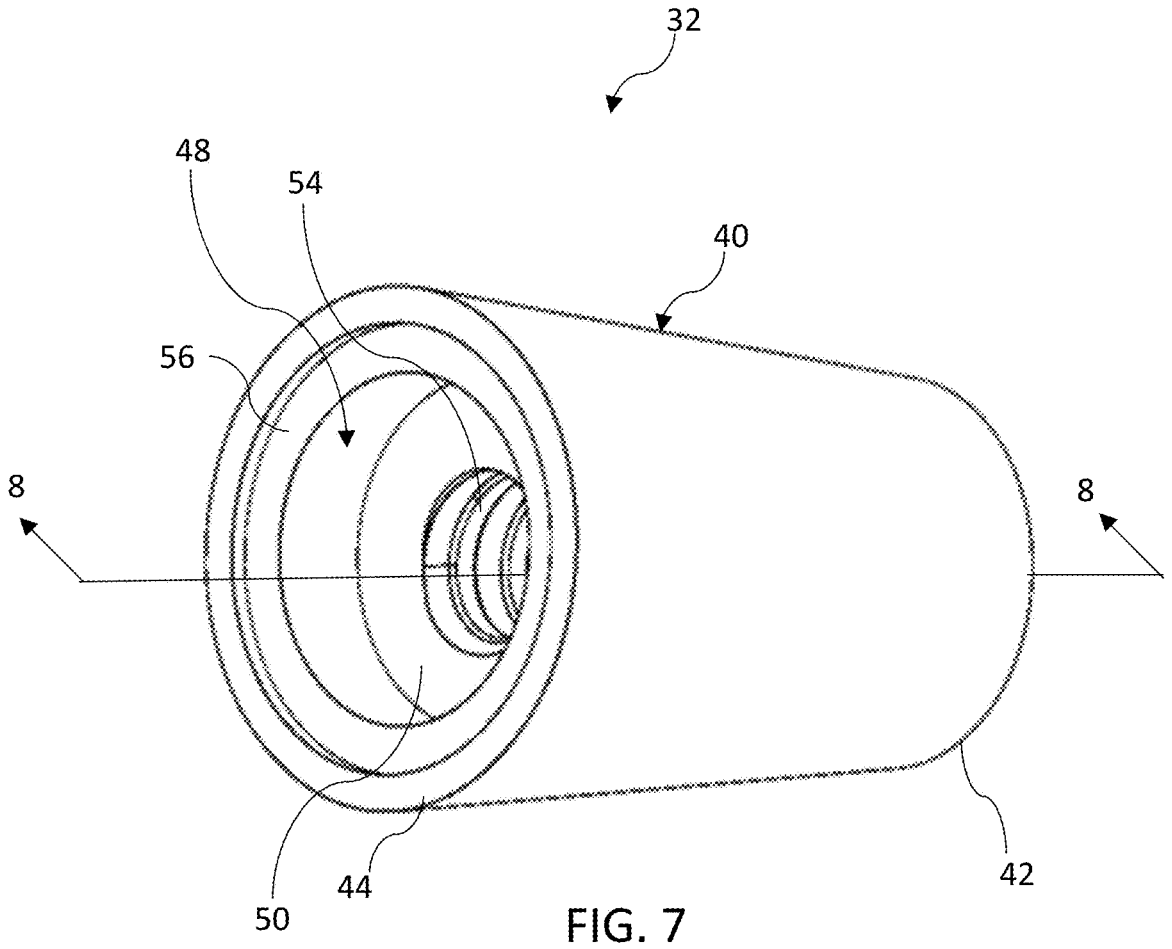
FIG. 7 is an outboard end perspective view of an outer body of the spring-biased end cap of FIG. 4.
Figure 8:
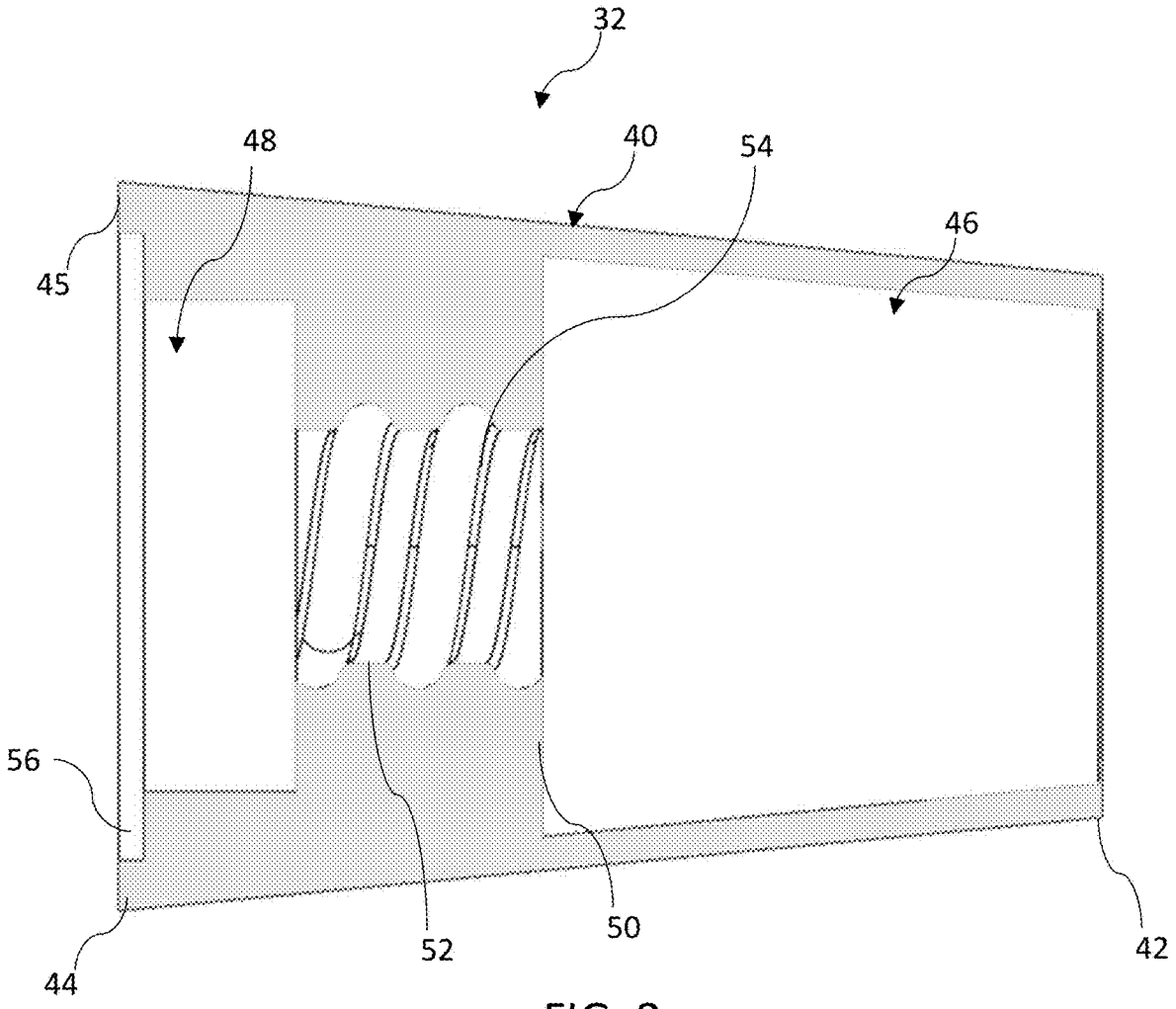
FIG. 8 is a cross-sectional view of the outer body of FIG. 7 taken along line 8-8 of FIG. 7.

In one example, a spring having a length as illustrated in FIG. 6 extends through the entire passage 52, though not into the cavity 48, and a distance d the intermediate portion 39 extends is $d_1$, wherein $d_1$ results in a desirable amount of spring force or tension when the spring is compressed during mounting. In another example, a longer spring may be used, and terminal coils of the spring 36 can be threaded past the passage 52 into the cavity 48 to maintain the same distance $d_1$ the intermediate portion 39 extends. Using a longer spring that may extend in part into the cavity 48 permits the distance d to be adjusted to increase or fine-tune the amount of spring force when the spring is threaded to a corresponding position.

Figure 9:
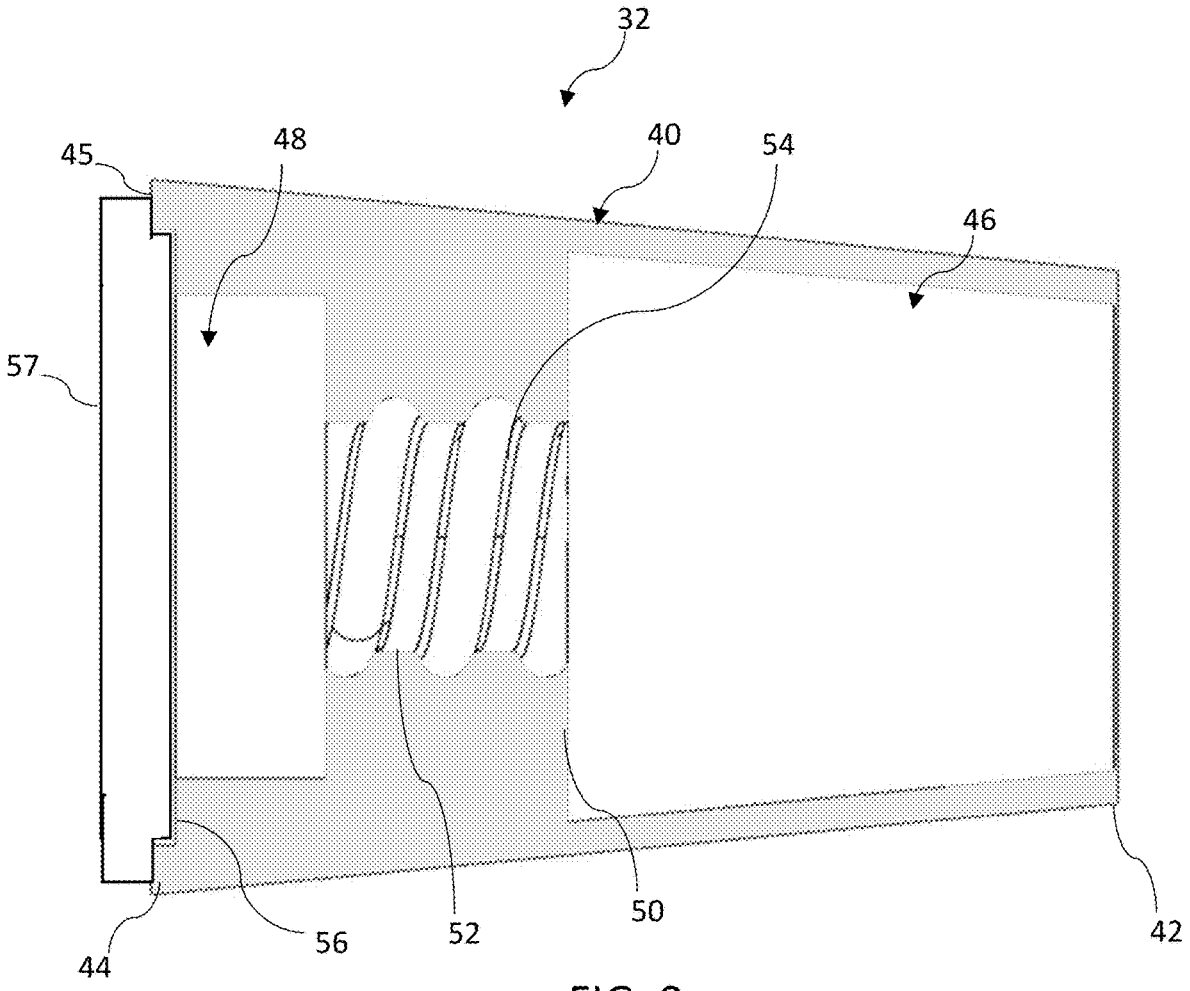
FIG. 9 is the cross-sectional view of FIG. 8 illustrated with a mounting pad attached to the outer body.
Figure 10:
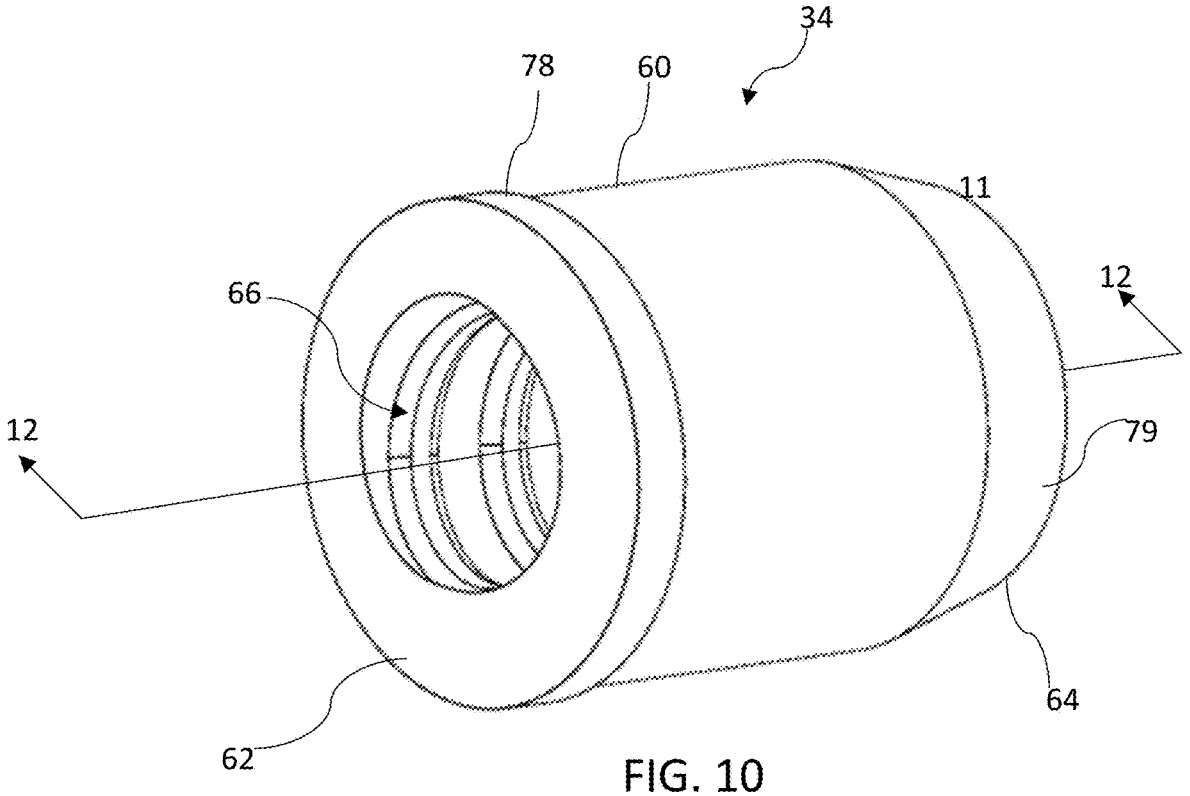
FIG. 10 is an outboard end perspective view of an inner body of the spring-biased end cap of FIG. 4.
Figure 11:
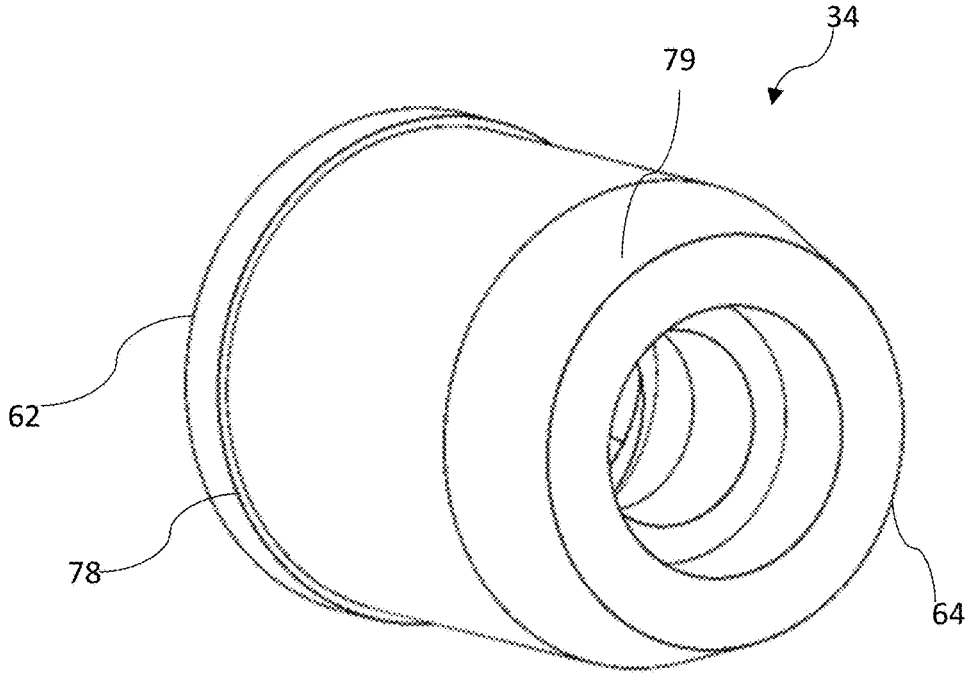
FIG. 11 is an inboard end perspective view of the inner body of FIG. 10.
Figure 12:
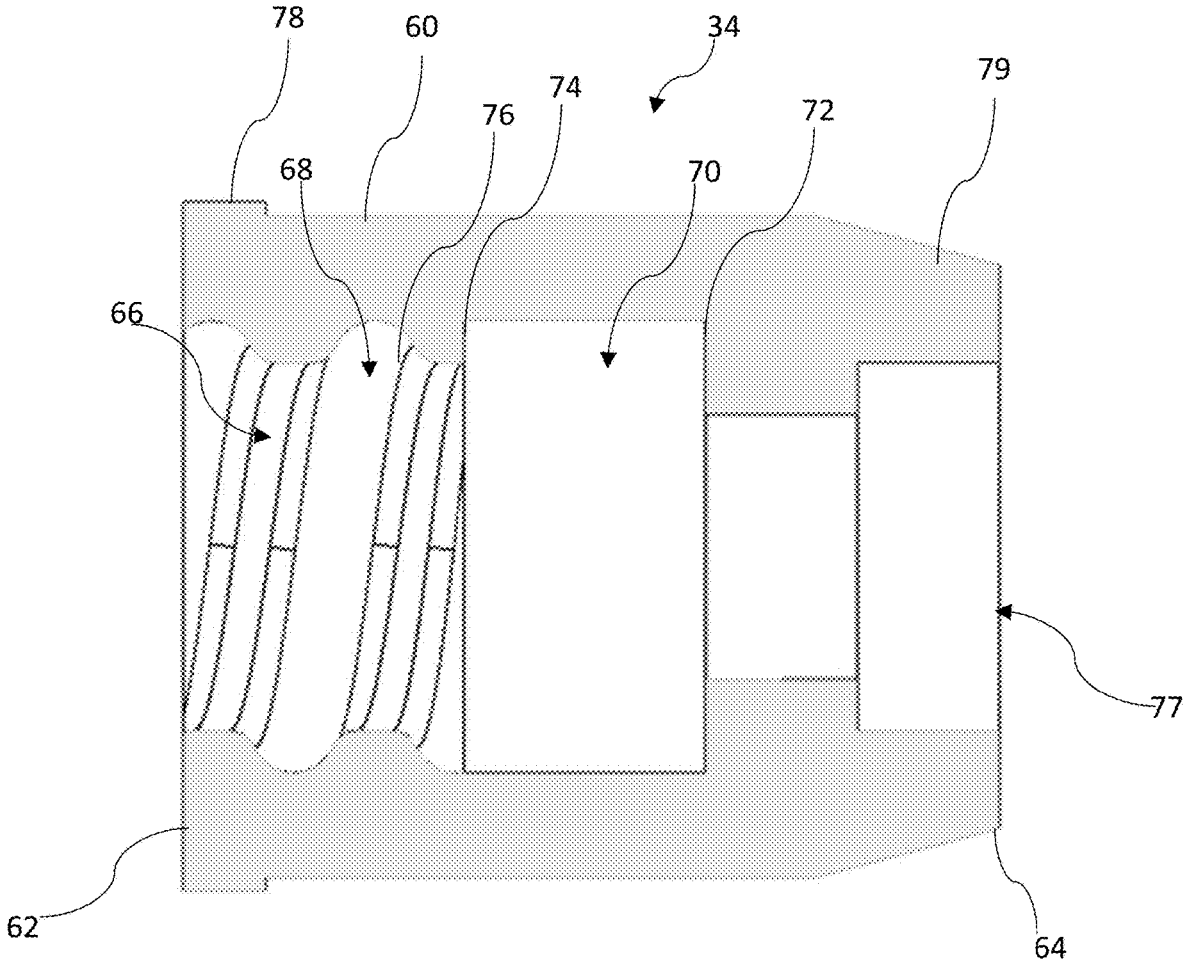
FIG. 12 is a cross-sectional view of the inner body of FIG. 10 taken along line 12-12 of FIG. 10.

The outboard end 44 is open and defines the cavity 48. The lateral annular wall 50 may define a partial annular floor or inner boundary to the cavity 48. The outer wall 40 of the outer body 32 forms an annular face 45 at the outboard end 44 that may engage a perimeter portion of a mounting pad 57 (FIG. 9). The outboard end 44 also defines an annular recess 56 outboard of and about the cavity 48 shaped to receive the perimeter portion of the mounting pad 57 (FIG. 9). The mounting pad 57, for example, may have a disc configuration and may protrude past the annular face 45 in some embodiments. The mounting pad may be coupled to the recess 56 and/or annular face 45, for example by gluing or welding. The mounting pad may be a softer material that engages the mounting surface with enhanced friction to prevent slipping therebetween.

With reference to FIGS. 3, 6 and 10-12, the inner body 34 has a first end portion 62 and a second end portion 64. The first end portion 62 defines a passage 66 for receiving the second end portion 38 of the spring 36. The inner body 34 is defined in part by an outer wall 60 that may have an annular configuration. The outer wall 60 is generally cylindrical at the first end portion 62. The second end portion 64 may be generally frusto-conical. For example, at the second end portion 64, the outer wall 60 may angle or taper radially inwardly relative to the outer wall 60 at the first end portion 62 such that the second end portion 64 has a smaller outer diameter than the first end portion 62. An angled surface 79 thus defined at the second end portion 64 facilitates insertion of the inner body 34 into the outer rod 14. In some embodiments, the second end portion 64 of the inner body 34 may protrude from the outer body 32 when the spring 36 is in its neutral (non-compressed) position (see FIGS. 4 and 6), with the transition to the angled surface 79 generally aligned with the edge of the inboard end 42 of the outer body 32.

The second end portion 64 may be open at its end with a hollow interior or passage 77. In some embodiments, the hollow interior 77 of the second end portion 64 and the passage 66 at the first end portion 62 are continuous with one another and define a continuous central through-opening along the entire length of the inner body 34.

The first end portion 62 has an outer diameter that is slightly smaller than the inner diameter of the outer rod 14 so that the outer rod 14 is coaxially received over the inner body 34 with a friction fit. The first end portion 62 may also include an annular flange 78 extending radially from the outer wall 60. The inner body 38 may be inserted into the outer rod 14 until the annular flange 78 abuts an end of the outer rod 14. Thus, the annular flange 78 prevents further insertion of the inner body 34 into the outer rod 14.

In some configurations, the spring-biased end cap 30 may be alternatively configured to receive the inner rod 12 instead of the outer rod 14. In this case, the inner body 34 may be sized to permit a friction fit with the inner rod 12.

The passage 66 for receiving the second end portion 38 of the spring 36 may include a first portion 68 with threading or grooves 76. In some embodiments, there may be a second portion 70 without threading or grooves inboard of the first portion 68. In some embodiments, both portions may have threading or grooves or there may be a single threaded or grooved portion that receives the second end portion 38 of the spring 36 without an additional portion.

The first portion 68 is sized to receive and retain the second end portion 38 of the spring 36. Specifically, the first portion 68 includes one or more grooves or internal helical threading 76 configured to engage and retain one or more coils of the spring 36. The threading may be partial, discontinuous threading or may be continuous threading.

The grooves or threading 76 of the first portion 68 may, for example, engage at least one coil of the spring 36, at least two coils of the spring 36, or three or more coils of the spring 36, and may have a function like the grooves or threading 54 of the passage 52 of the outer body 32. The coils of the spring 36 may be retained by the grooves or threading 76 such that the retained coils, in use, are held from at least substantial translation within or out of the passage 52. In some embodiments, the grooves or threading 76 retains the coils so that compression or expansion of the coils is reduced or inhibited. In some embodiments, the coils are retained by the grooves or threading 76 to permit some compression or expansion, though at an amount that is less than the compression or expansion of the unretained coils of the intermediate portion 39 of the spring 36.

The second portion 70 of the passage 66 may define a substantially cylindrical space sized to receive and retain one or more terminal coils of the spring 36. In some configurations, the second portion 70 is sized to retain at least one, at least two, or at least three coils of the spring 36. The second portion 70 may be sized to retain the coils of the spring 36 therein in a compressed configuration. The inner diameter of the second portion 70 may be slightly larger than the outer diameter of the spring 36 to closely engage and retain the spring 36. In addition, the second portion 70 may be bound in part by an annular step 72 extending radially inwardly from the outer wall 60 between the first end portion 62 and the second end portion 64 of the inner body 34. The spring 36 may abut the annular step 72. In some configurations, the annular step 72 is replaced by a lateral wall that entirely closes off the second portion 70 from the second end portion 64. In certain embodiments, the second portion 70 may have a function like cavity 48 of allowing space for the spring to occupy if the distance $d_1$ the intermediate portion 39 of the spring 36 extends needs to be adjusted.

Like the passage 52 of the outer body 32, the passage 66 of the inner body 34 supports and retains the spring 36 so that it is not dislodged during use, storage, and/or transportation. Further, in some embodiments, a substantial portion of the coils of the spring 36 are retained or secured within the passage 52 of the outer body 32 and the passage 66 of the inner body. In embodiments, at least 20% of the spring may be retained or secured within the passage 52 of the outer body 32 and the passage 66 of the inner body 34. In other embodiments, at least 30% of the spring may be retained or secured in this manner, at least 40%, or at least 50%. This helps to maintain the spring 36, inner body 34, and outer rod 14 in a connected, aligned, coaxial position along central longitudinal axis Y, and substantially perpendicular to the lateral wall 50 and the mounting surfaces, all while enabling movement between the outer body 32 and the inner body 34.

Figure 3:
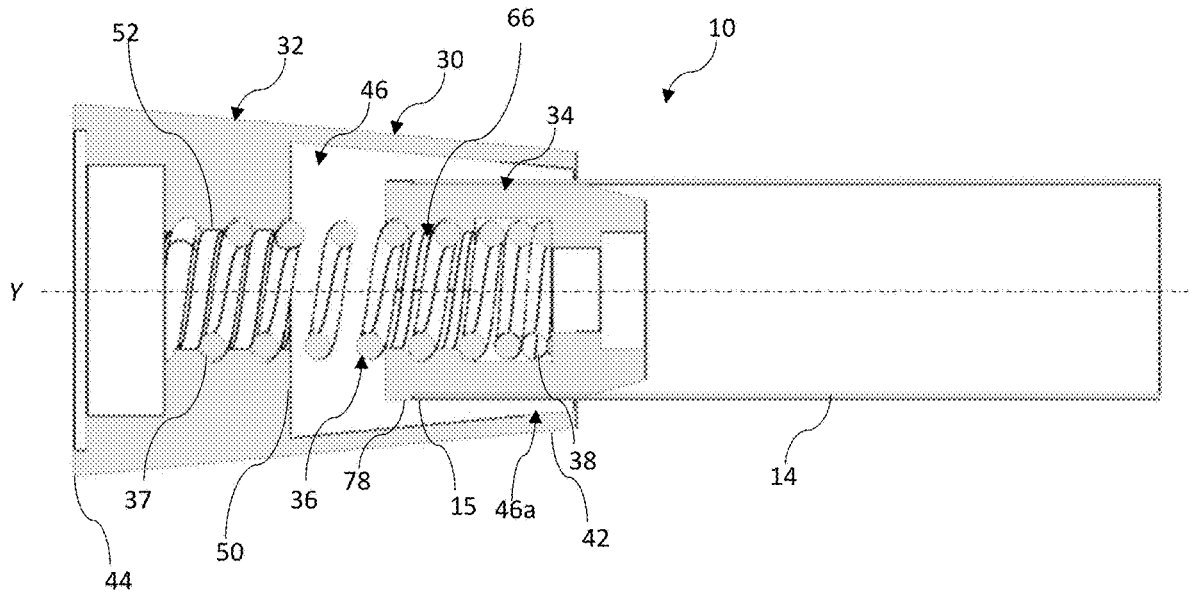
FIG. 3 is a cross-sectional view of a portion of the rod assembly of FIG. 1 taken along line 3-3 of FIG. 1.
Figure 4:
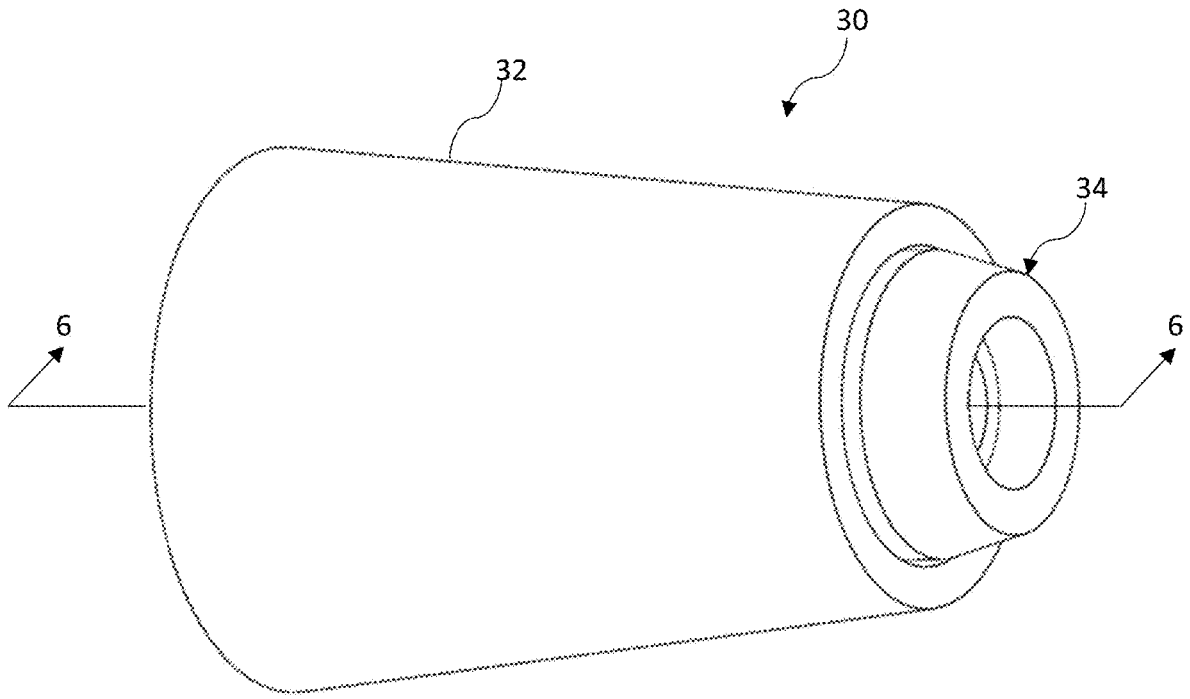
FIG. 4 is an inboard end perspective view of a spring-biased end cap of the rod assembly of FIG. 1.
Figure 5:
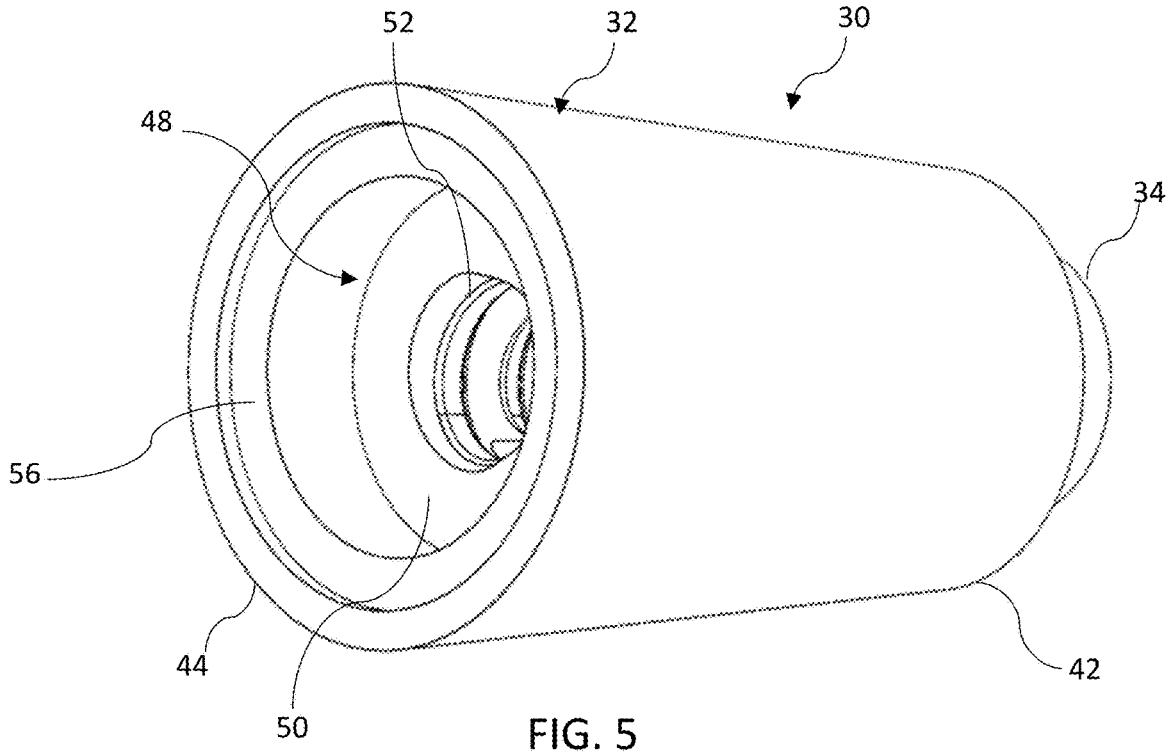
FIG. 5 is an outboard end perspective view of the spring-biased end cap of FIG. 4.

As illustrated in FIGS. 3 and 6, while a first end portion 37 of the spring 36 is retained in the passage 52 and a second end portion 38 is retained in the passage 66, the intermediate portion 39 of the spring 36 extends freely within the cavity 46 of the outer body 32 between the passage 52 and the passage 66. Specifically, the intermediate portion 39 extending freely within the cavity 46 includes two or more coils that, in use, permit compression or expansion of the spring 36 and permit displacement of the inner body 34 and the outer body 32 relative to one another.

For instance, in a neutral, non-mounted position of the spring-biased end cap 30 and of the spring 36 (e.g., prior to mounting the rod assembly 10 and spring-biased end cap 30 to a mounting surface), the intermediate portion 39 of the spring 36 is fully extended and the first end 62 of the inner body 34 is a first or initial distance $d_1$ from the lateral wall 50 of the outer body 32. In a mounted position of the spring-biased end cap 30 and of the spring 36, the intermediate portion 39 of the spring 36 is compressed to some extent and the first end 62 of the inner body 34 is a second distance $d_2$ from the lateral wall 50 of the outer body 32, where $d_2$ is less than $d_1$. In some embodiments, in the mounted position in which the spring 36 is compressed, the inner body 34 may be drawn entirely or almost entirely into the outer body 32 such that little to no portion of the inner body 34 (e.g., the second end portion 64) is protruding from the outer body 32.

It will be appreciated that the more $d_2$ is decreased relative to $d_1$ the more the amount of tension between the rod assembly 10 and the mounting surfaces is increased when the rod assembly 10 is mounted.

With reference to FIG. 3, the cavity 46 may have a diameter larger than both the inner body 34 and the outer rod 14 to facilitate movement of the inner body 34 and the outer rod 14 within the cavity 46 when the spring compresses or expands. There may be an annular gap or space **46*a* between the outer rod 14 and the wall of the cavity 46 when the outer rod 14 is received on the inner body 34 so that the outer rod 14 and the inner body 34 do not contact the outer body 32. Alternatively, the gap 46*a* could be so small that there is light frictional contact between the inner body 34 and the outer rod 14 to aid in guiding reciprocating movement of the outer rod 14 relative to the inner body 34**.

Figure 13:
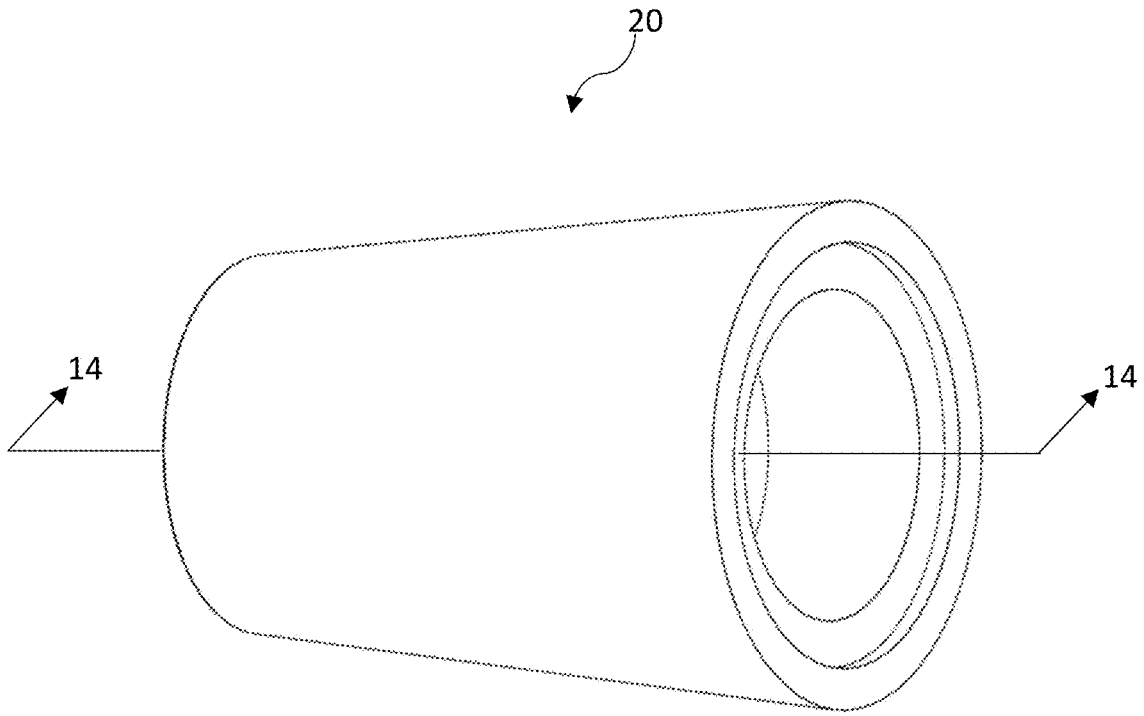
FIG. 13 is an outboard end perspective view of an end cap of the rod assembly of FIG. 1 that is not spring-biased.
Figure 14:
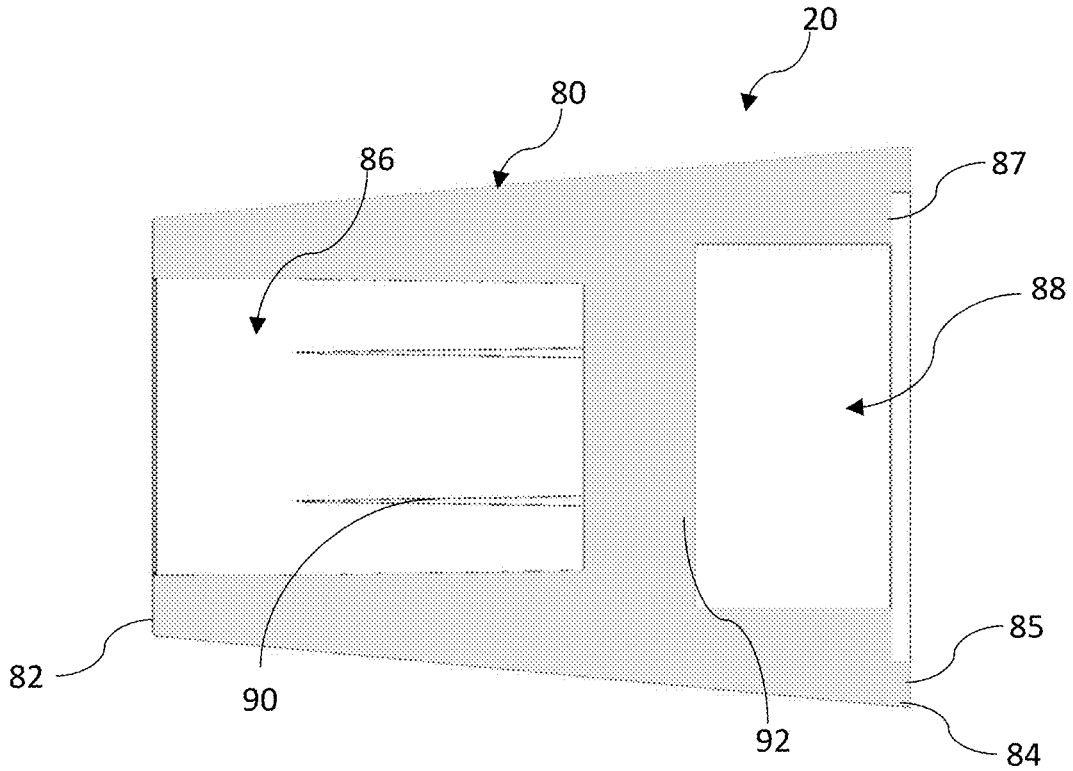
FIG. 14 is a cross-sectional view of the end cap of FIG. 13 taken along line 14-14 of FIG. 13.

With reference to FIGS. 13-14, the end cap 20 may be a non-spring-biased end cap. However, in some embodiments the end cap 20 may be a spring-biased end cap like spring-biased end cap 30, or another type of adjustable end cap (e.g., a rotating adjustable end cap). In the illustrated embodiment, the end cap 20 is a non-spring-biased end cap having an inboard end 82 for receiving the inner rod 12 (or, in some embodiments, the outer rod 14) and an outboard end 84 for mounting to one of two opposing support surfaces. In certain embodiments, the non-spring-biased end cap 20 may be a single piece with a body 80 having the same or similar outer profile as the outer body 32 of the spring-biased end cap 30. As illustrated, the body 80 has a frustoconical outer profile, with the outer diameter of the body 80 increasing from the inboard end 82 to the outboard end 84. In other configurations, the body 80 may be generally cylindrical or have different geometries (e.g., bell-shaped). The inboard end 82 is open and defines a hollow interior or passage 86 which receives the inner rod 12. Specifically, the passage 86 may be sized and shaped to receive an end of the inner rod 12 with a friction fit. The passage 86 may include one or more longitudinally extending tapered fins or ribs 90 to enhance the frictional engagement with the inner rod 12 within the passage 86.

The outboard end 84 is open and defines a cavity 88. A lateral wall 92 may define a floor to both the cavity 88 and the passage 86 and separate the cavity 88 from the passage 86. The outboard end 84 defines an annular face 85 to engage the mounting surface. The outboard end 84 also defines an annular recess 87 about an opening to the cavity 88 that receives a perimeter portion of a mounting pad like the mounting pad 57 shown in FIG. 9 in the spring-biased end cap 30. The mounting pad may be coupled to the recess 87, for example by gluing or welding.

Figure 2:
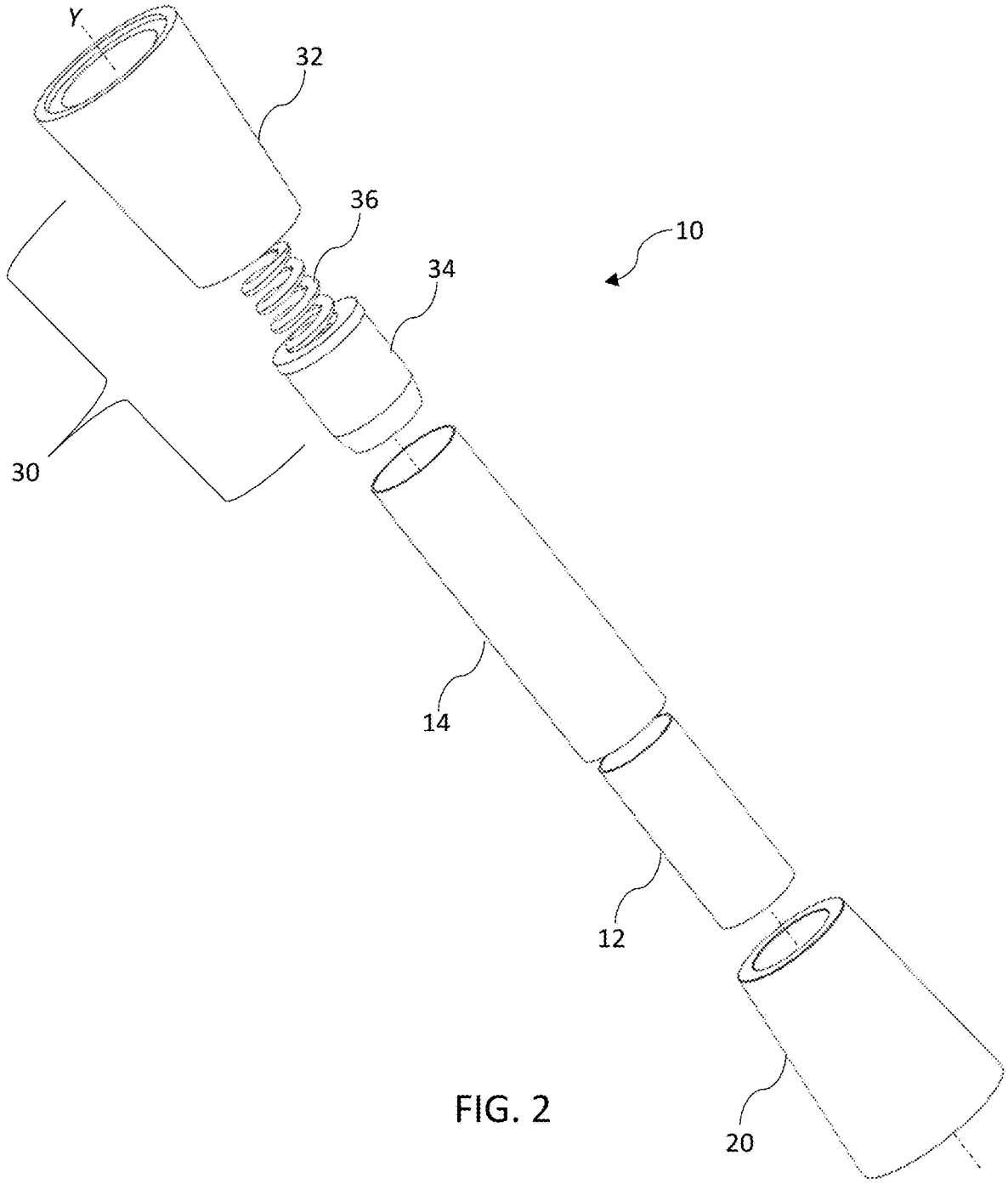
FIG. 2 is an exploded view of the rod assembly of FIG. 1.

With reference to FIGS. 1-3, a method of mounting a rod assembly 10 may have the following steps. An end of the inner rod 12 may be inserted into the end cap 20 until a secure friction fit is obtained. An end of the outer rod 14 may be inserted into the cavity 46 of the spring-biased end cap 30 in engagement with the inner body 34. Specifically, the inner body 34 is inserted into the outer rod 14 with a friction fit securing the outer rod 14 to the inner body 34. In some embodiments, the inner body 34 may be inserted into the outer rod 14 until the outer rod 14 abuts the annular flange 78 of the inner body 34. It will be appreciated that in other embodiments the inner rod 12 engages the spring-biased end cap 30 and the outer rod 14 engages the end cap 20, and that the end cap 20 could be a second spring-biased end cap or a non-spring-biased end cap.

The inner rod 12 may then be partially inserted into or extended from the outer rod 14 until the combined length of the inner rod 12 and the outer rod 14 is a length that is appropriate for mounting the rod assembly between two opposing mounting surfaces. Specifically, the inner rod 12 and outer rod 14 should be coarsely adjusted to a length of the rod assembly 10 such that the rod assembly 10 including the end caps 20, 30 is slightly longer than the distance between the two opposing mounting surfaces. A lock mechanism may be used to lock the inner rod 12 and outer rod 14 to the desired length so that the inner rod 12 and outer rod 14 are fixed from movement relative to one another and at the adjusted length.

The rod assembly 10 may then be mounted by first holding the end cap 20 (e.g., a non-spring-biased end cap) against a first mounting surface and then bringing the other end of the rod assembly 10 and the spring-biased end cap 30 towards a second opposing mounting surface. Since the rod assembly 10 is slightly longer than the distance between the two opposing mounting surfaces, the outer body 32 of the spring-biased end cap 30 may then be pushed in the direction of the end cap 20 to compress the spring 36 and move the outer body 32 relative to the inner body 34 and the rest of the rod assembly 10, thereby shortening the length of the rod assembly 10 until it fits between the two opposing mounting surfaces and both end caps 20, 30 are engaging the mounting surfaces. After releasing the rod assembly 10, the compressed spring 36 extends to a slightly less compressed state to force the end caps 20, 30 securely against the mounting surfaces. That is, the spring 36 finely adjusts the rod assembly 10 for a secure fit between the mounting surfaces. The compressed spring 36 exerts force on the outer body 32 of the spring-biased end cap 30 and the inner body 34 of the spring-biased end cap 30 to hold the rod assembly 10 in tension between the mounting surfaces.

The rod assembly 10 may alternatively be mounted by first holding the outboard end 44 of the spring-biased end cap 30 against the first mounting surface as the opposite end of the rod assembly 10 with the end cap 20 is brought towards the second opposing mounting surface. The end cap 20 or the inner rod 12 is then pushed in the direction of the spring-biased end cap 30, which moves the outer rod 14 and inner body 34 of the spring-biased end cap 30 to compress the spring 36 and thereby shorten the length of the rod assembly 10 until it fits between the two opposing mounting surfaces and both end caps 20, 30 are engaging the mounting surfaces.

As noted above, greater compression of the spring provides greater tension when the rod assembly 10 is mounted. As such, adjusting the total length of the rod assembly 10 such that the intermediate portion 39 of the spring 36 becomes fully or nearly fully compressed in the mounting position may be desirable for achieving a firm and secure hold on the mounting surfaces.

In certain embodiments, the method may also finetune the amount of spring force generated by the spring by changing the distance $d_1$ the intermediate portion 39 of the spring 36 extends in the neutral position of the spring 36, wherein $d_1$ may be approximately equated to the initial distance between the first end 62 of the inner body 34 and the lateral wall 50 of the outer body 32. Changing the distance $d_1$ may be accomplished by adjusting the amount of the spring 36 that is threaded through the passage 52. It can also be accomplished by adjusting the amount of the spring extending into the cavity 48 beyond the passage 52 or extending into the passage 66 (e.g., the second portion 70 thereof) of the inner body 34. Alternatively, or in addition to, the distance $d_1$ may be adjusted by using a longer spring and permitting the inner body 34 to protrude out further from the outer body 32 in the neutral position.

The force provided by the spring-biased end cap 30, in some embodiments, has an effect on the locking mechanism between the rods 12, 14, such as one of the locking mechanisms described in U.S. Pat. Nos. 10,959,559, 11,382,447, and U.S. Publication No. 2023/0277012, all of which are incorporated by reference herein in their entireties. For example, the above-noted activity of the spring-biased end cap 30 may also force the locking mechanism into a more secure or locked state of the two rods 12, 14 relative to each other.

The rod assembly 10 may be horizontally or vertically mounted and may be used for supporting curtains over a window or as a shower rod for supporting a shower curtain. Other non-limiting uses may be as a closet pole for hanging clothes or as a shower caddy.

Figure 15:
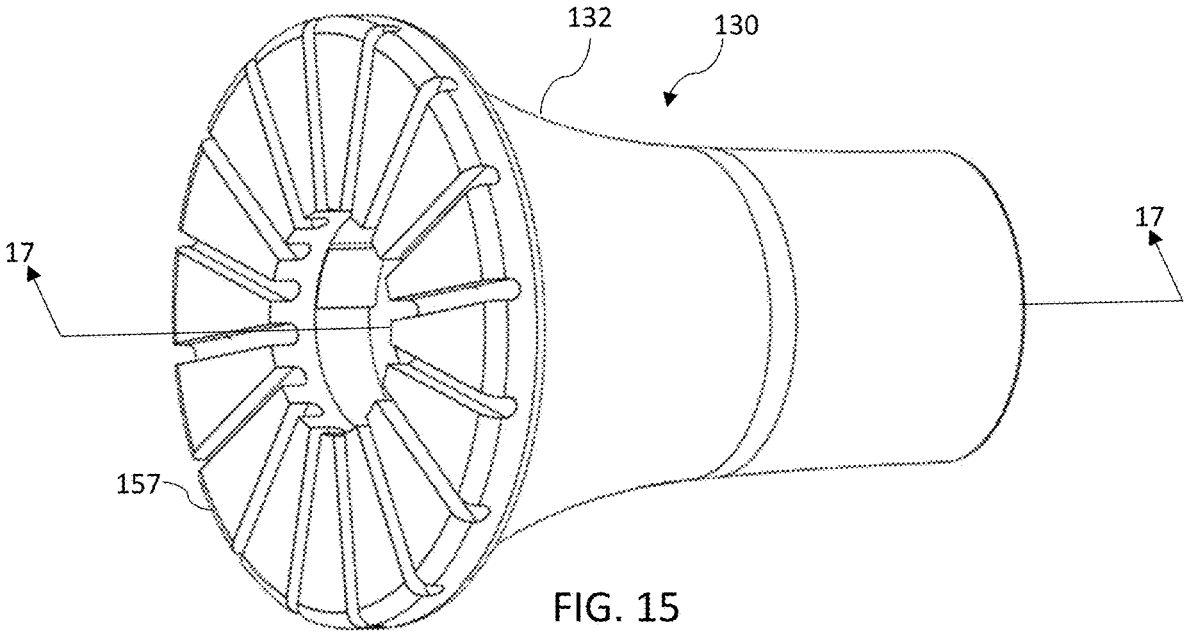
FIG. 15 is an outboard end perspective view of a spring-biased end cap according to a second embodiment.
Figure 16:
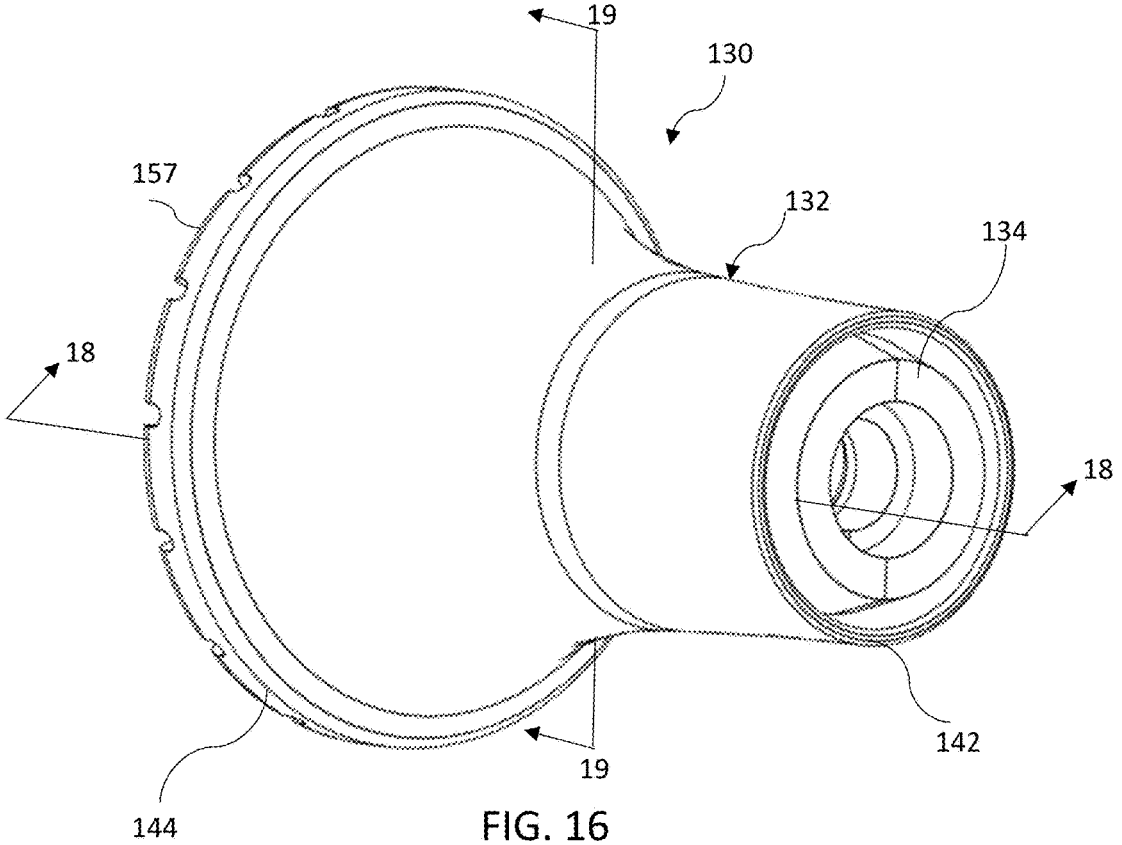
FIG. 16 is an inboard end perspective view of the spring-biased end cap of FIG. 15.
Figure 17:
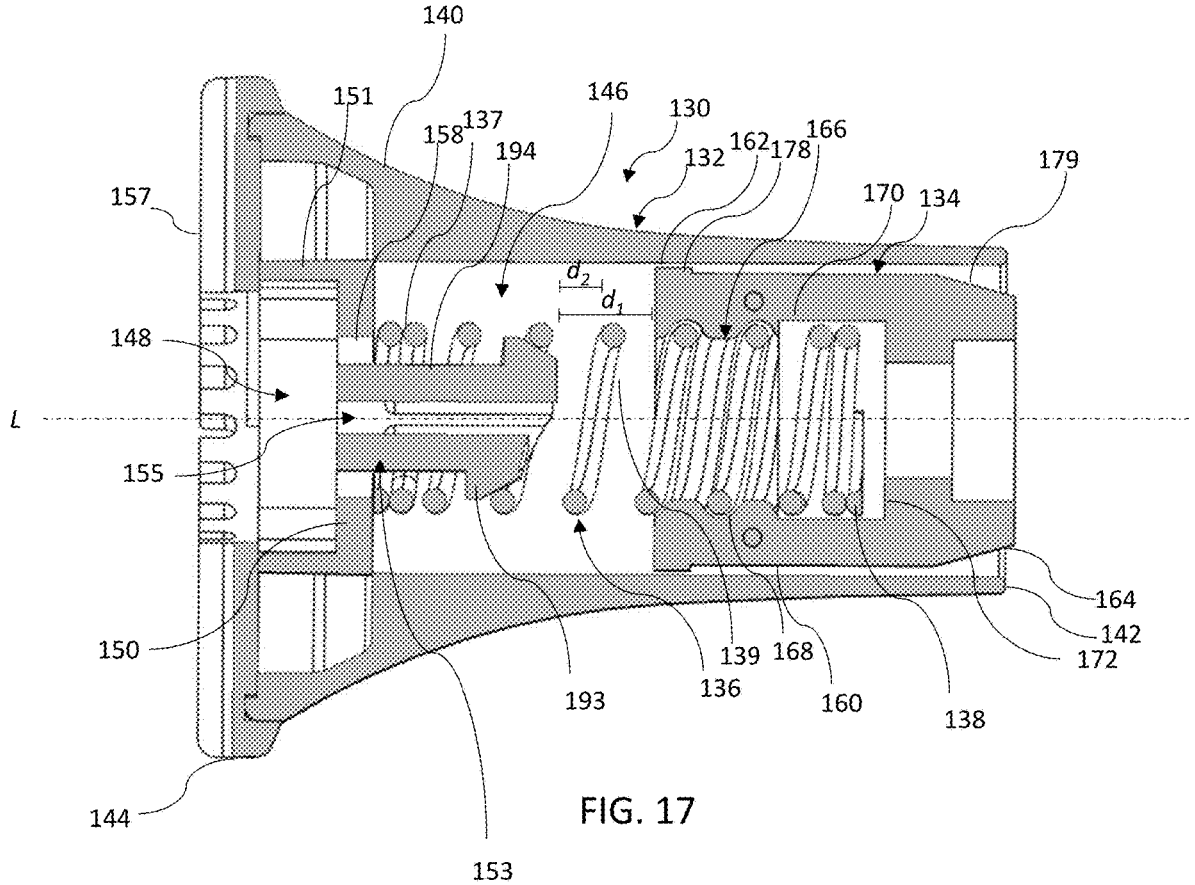
FIG. 17 is a cross-sectional view of the spring-biased end cap of FIG. 15 taken along line 17-17 of FIG. 15.
Figure 18:
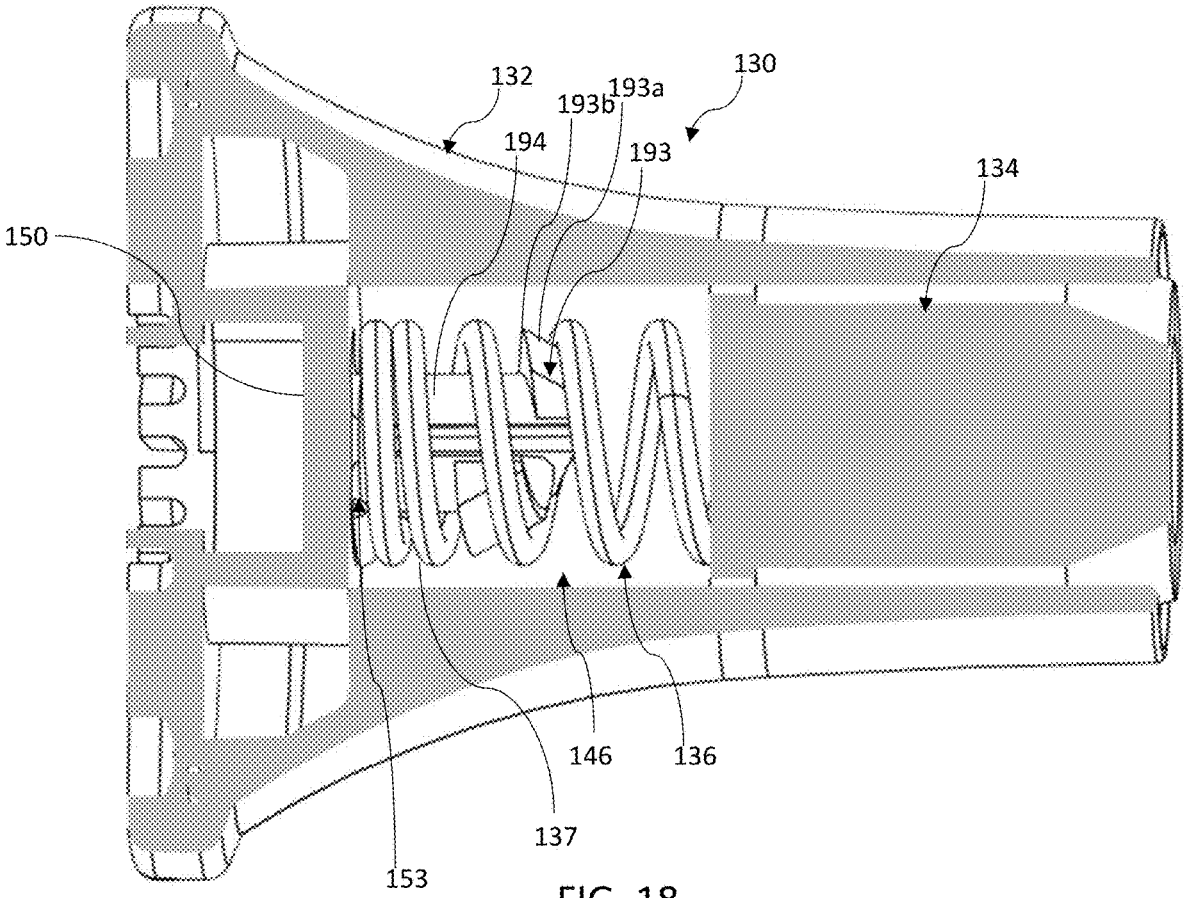
FIG. 18 is a cross-sectional view of the spring-biased end cap of FIG. 15 taken along line 18-18 of FIG. 16.
Figure 19:
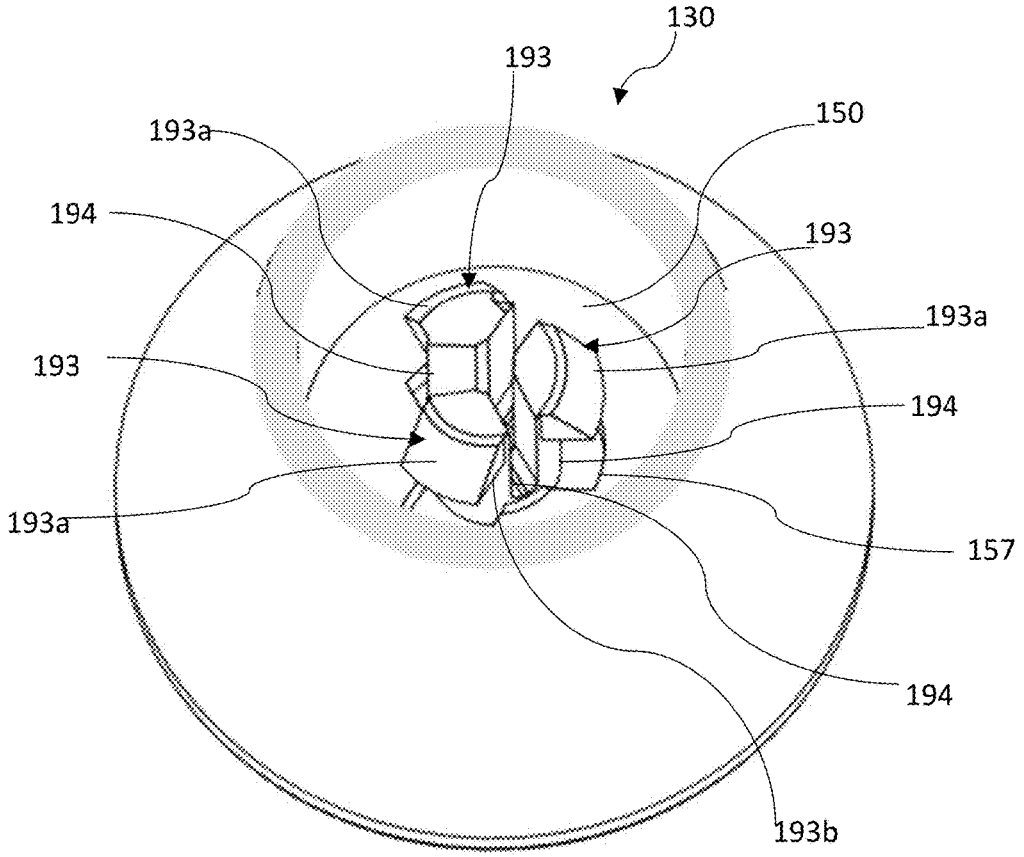
FIG. 19 is a cross-sectional view of the spring-biased end cap of FIG. 15 taken along line 19-19 of FIG. 16, shown with the mounting pad and spring removed.
Figure 20:
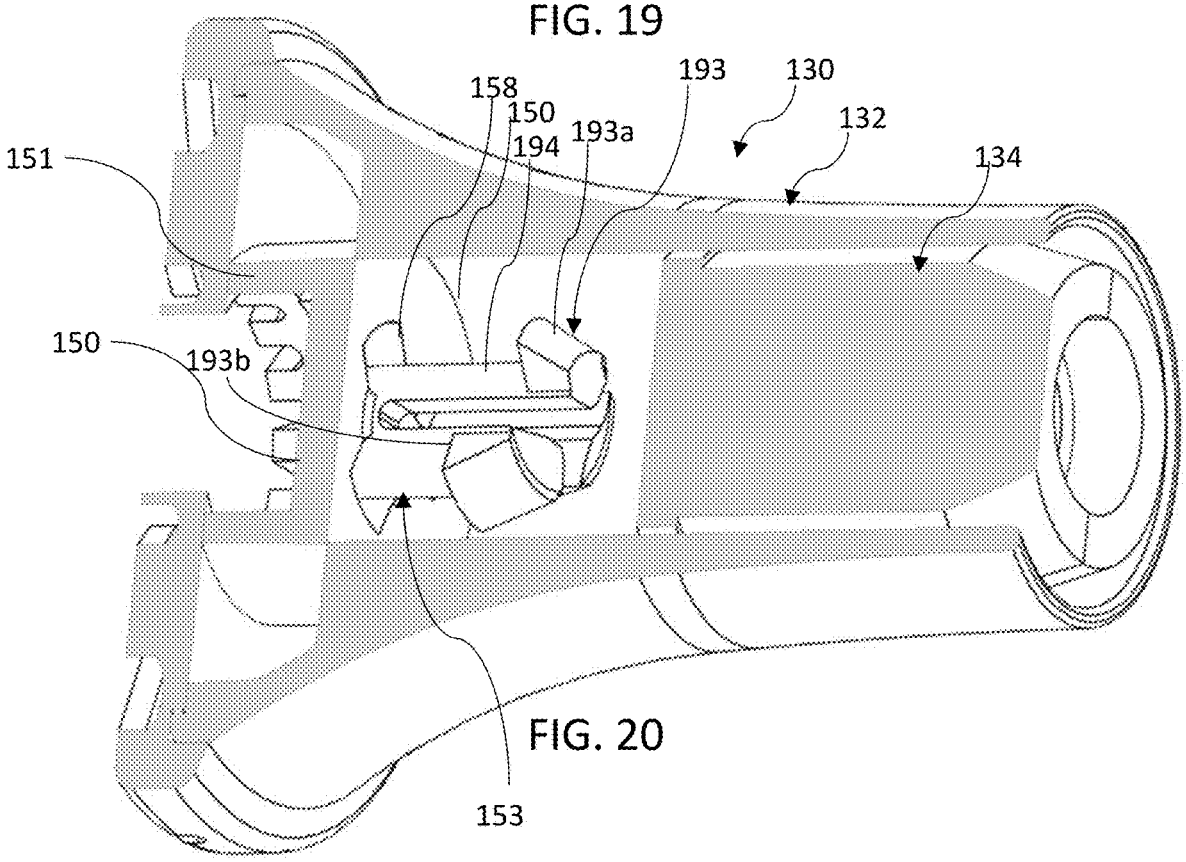
FIG. 20 is the cross-sectional view of FIG. 18, of the spring-biased end cap of FIG. 15, shown with the spring and the mounting pad removed.
Figure 21:
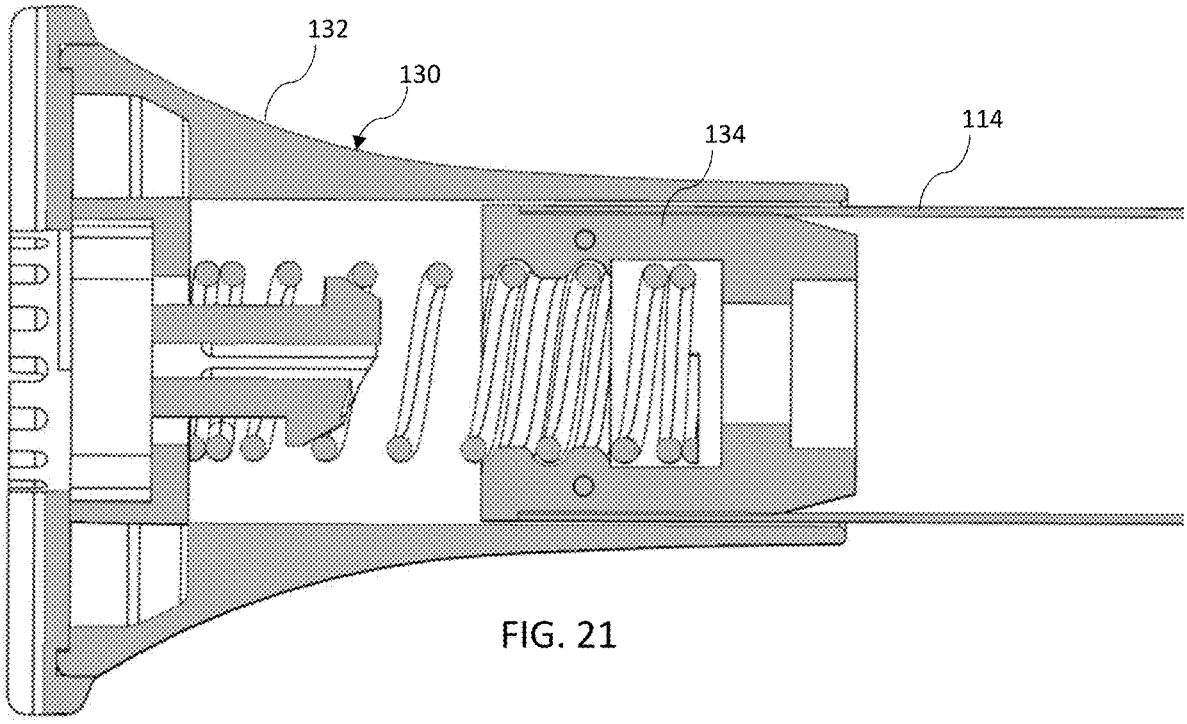
FIG. 21 is the cross-sectional view of FIG. 17, of the spring-biased end cap of FIG. 15, shown with the spring-biased end cap coupled to a rod.
Figure 22:
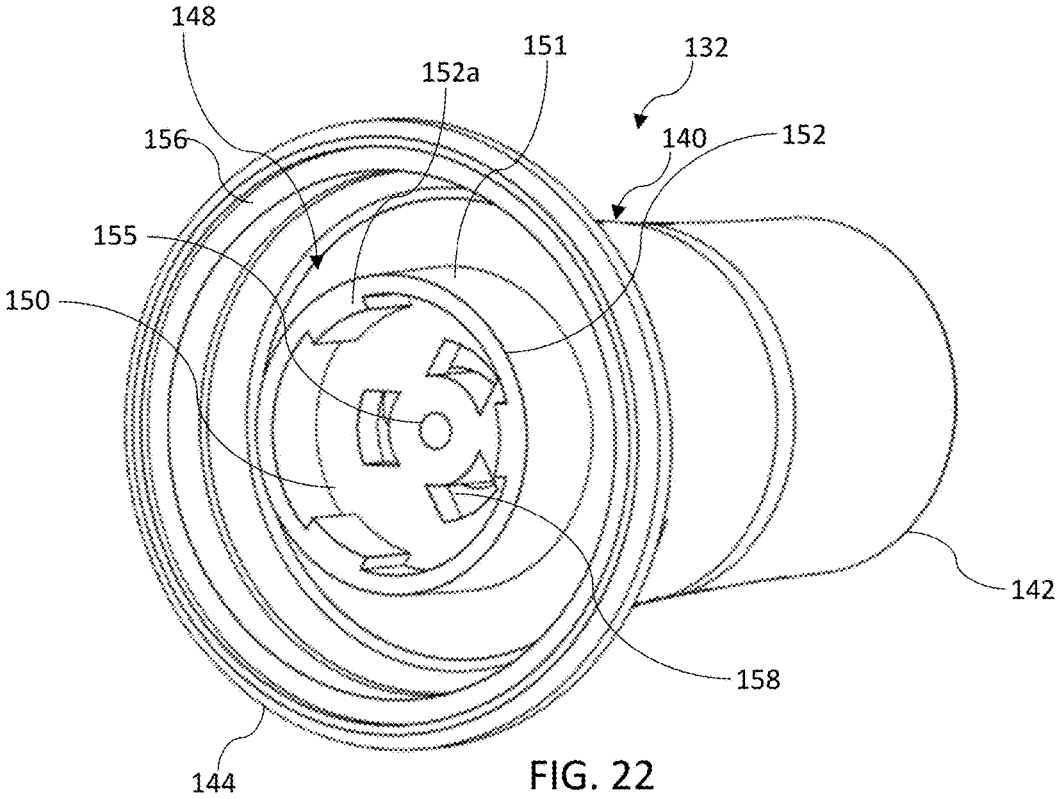
FIG. 22 is an outboard end perspective view of an outer body of the spring-biased end cap of FIG. 15.
Figure 23:
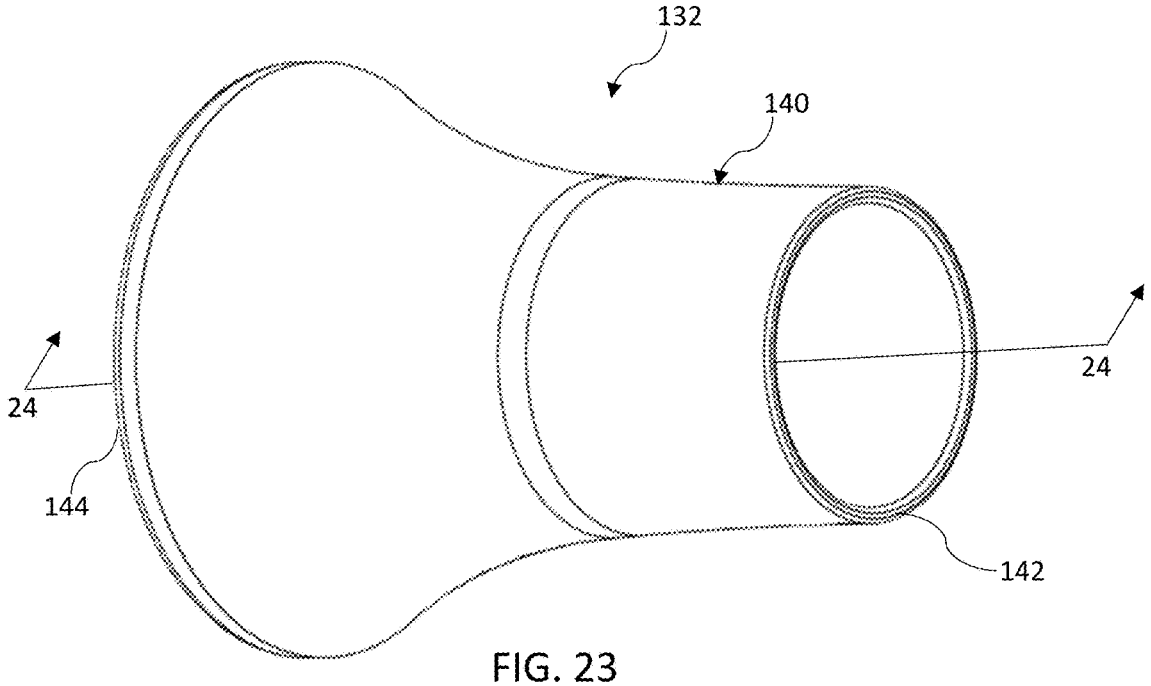
FIG. 23 is an inboard end perspective view of the outer body of FIG. 22.
Figure 24:
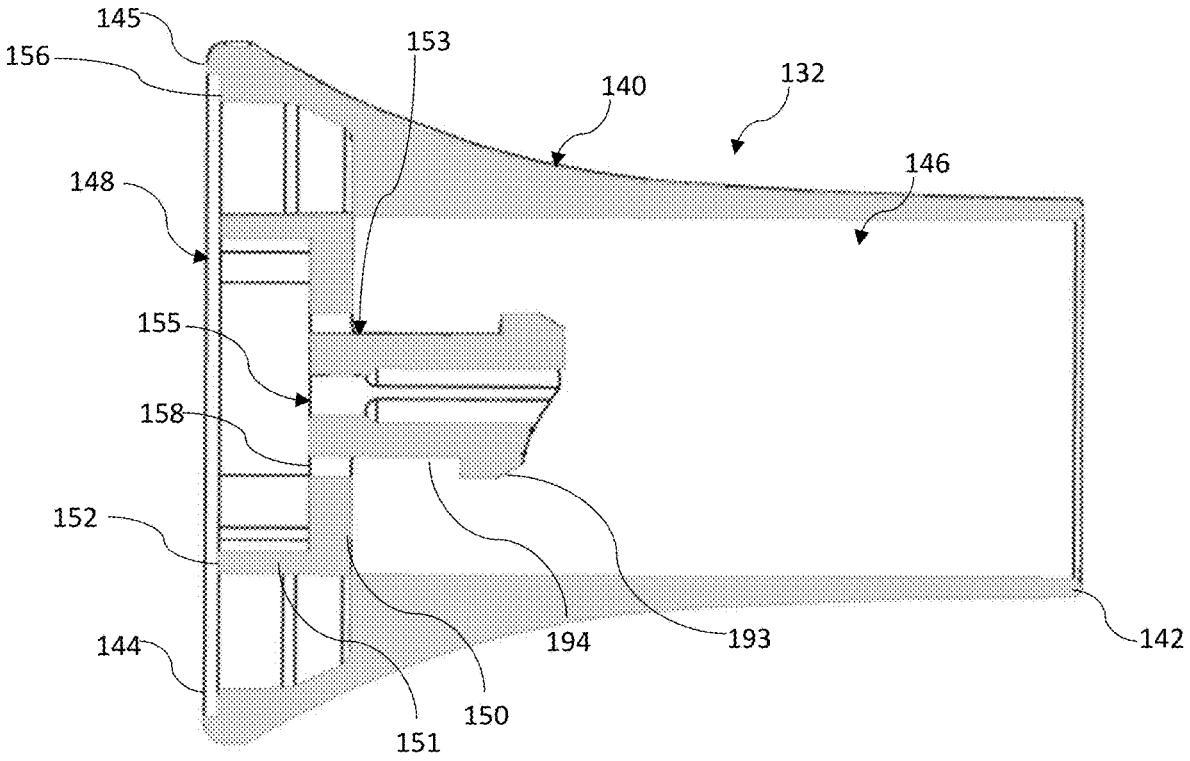
FIG. 24 is a cross-sectional view of the outer body of FIG. 22, taken along line 24-24 of FIG. 23.

With reference to FIGS. 15-17, there is illustrated another spring-biased end cap 130. Many features of the spring-biased end cap 130 are like those discussed above for the spring-biased end cap 30. Common features are denoted with the same number except the number will begin with a "1" for the spring-biased end cap 130. To the extent some of the common features are not specifically referenced in the description of spring-biased end cap 130, the description of the same features present in spring-biased end cap 30 are incorporated by reference.

With reference to FIGS. 1 and 15-17, the spring-biased end cap 130 may be used in rod assembly 10, for example, in place of spring-biased end cap 30 and/or end cap 20. The spring-biased end cap 130 is fitted to inner rod 12 or outer rod 14 and, in use, engages one of two opposing support surfaces. Like the spring-biased end cap 30, in use, the spring-biased end cap 130 adjusts to provide sufficient tension between the rod assembly 10 and opposing support surfaces so that the rod assembly 10 is securely held between the opposing support surfaces.

The spring-biased end cap 130 includes an outer body 132, an inner body or insert 134, and a spring 136. The inner body 134 is at least partially received within a cavity 146 of the outer body 132 and is movably coupled to the outer body 132 via the spring 136. Specifically, the spring 136 may be a helical compression spring and may have a first end portion 137 coupled to the outer body 132 and a second end portion 138 coupled to the inner body 134 to thereby secure the outer body 132 to the inner body 134. An intermediate portion 139 of the spring 136 extends through the cavity 146 of the outer body 132 and permits displacement or a change of position of the inner body 134 and the outer body 132 relative to one another when the spring 136 compresses or expands.

With reference to FIGS. 17 and 21-24, the outer body 132 has an inboard end 142 for receiving the inner body 134 and the outer rod 114 (or the inner rod in some configurations) and an outboard end 144 for mounting to the support surface. In the illustrated embodiment, the outer body 132 is bell-shaped or curved, with the outer diameter of an outer wall 140 of the outer body 132 increasing from the inboard end 142 to the outboard end 144. The outer wall 140 may be tapered to define the bell-shape. In other configurations, the outer body 132 may be generally cylindrical or have other geometries (e.g., frustoconical).

The inboard end 142 is open and defines the hollow interior or cavity 146 which receives the inner body 134, the outer rod 114 (or the inner rod), and the spring 136. The cavity 146 may be substantially cylindrical with a uniform inner diameter, as illustrated. In other embodiments, the shape of the cavity 146 may follow the bell curve of the outer body 132, gradually increasing from the inboard end 142 towards the outboard end 144. The cavity 146, as described further below, is dimensioned to receive and permit movement or displacement of the inner body 134, spring 136, and outer rod 114 relative to the outer body 132 so that the rod assembly 10 can adjust to an appropriate length to hold the rod assembly in tension between opposing support surfaces.

With reference to FIGS. 17-20 and 22, the outer body 132 includes a lateral wall 150 extending radially inwardly relative to the outer wall 140 and defining a bottom or inner boundary of the cavity 146. A post 153 may extend into the cavity 146 at a central portion of the lateral wall 150. In embodiments, the post 153 is formed integrally with the lateral wall 150 and thus extends from the lateral wall 150. The lateral wall 150 and post 153 may share a central opening 155. The lateral wall 150 may have one or more cut-outs 158 therein spaced about the post 153 to permit air flow through the outer body 132. For instance, in the illustrated embodiment, there are three such cut-outs 158. In some embodiments, the post 153 may be a separate component from the lateral wall 150 that is fixed (e.g., welded) to the lateral wall 150.

The post 153 extends into the cavity 146 and functions to anchor or retain the first end 137 of the spring 136 within the outer body 132. Specifically, the post 153 is sized so that it can be inserted into the spring 136, with the spring 136 wrapped around the post 153. One or more barbs 193 project from or near a terminal end of the post into the cavity 146. The barbs 193 extend radially outwardly from the post 153, each including an inclined side surface 193*a* that angles or curves radially outwardly in the direction of the lateral wall 150 and a bottom surface 193*b* that extends perpendicular to the post 153. The barbs 193 may also have a degree of flexibility. In some cases, the inclined side surfaces 193*a* and/or the flexibility of the barbs facilitate insertion into coils of the spring 136 when the post 153 is being inserted into the spring 136. In addition, when the post 153 is inserted into the spring 136, the inclined side surfaces 193*a* of the barbs 193 may be positioned to support one or more coils of the spring 136 (as shown best in FIG. 18). As such, the barbs 193 may be positioned relative to one another at a pitch corresponding to the pitch of the coils of the spring 136.

The barbs 193 further function to retain the spring 136 on the spring-biased end cap 130 so that the spring 136 is not easily or unintentionally uncoupled from the end cap 130. In the illustrated embodiment, the spring 136 is installed in the end cap 130 so that one or more of the coils of the spring 136 are past the barbs 193 and the bottom surfaces 193*b* of the barbs 193 prevent the coils from passing back over the barbs 193. The barbs 193 keep the spring 136 securely attached to the post 153 and the end cap 130 during routine use of the end cap 130. In certain embodiments, the post 153 and/or positioning of the barbs 193 may permit the spring 136 to be unthreaded or unwound from the post 153 if needed (e.g., to replace the spring or adjust the amount of coils of the spring 136 extending freely within the cavity 146).

In embodiments, the post 153 may extend into a plurality of distinct post extensions 194 or fingers, each post extension 194 including one of the barbs 193 at an end thereof. For example, there may be three post extensions 194 and three barbs 193. The post extensions 194 and barbs 193 may be arranged about the central opening 155 of the post 153. The post extensions 194 may have different lengths and thus extend at different amounts into the cavity 146 so that the barbs 193 are positioned to correspond to the pitch of the spring 136. In certain configurations, the post extensions 194 and/or barbs 193 may be flexible, e.g., configured to deflect slightly inwardly when inserted into the spring 136.

In some embodiments, the post 153 may not extend into a plurality of distinct post extensions 194 and instead defines a cylindrical wall or body having one or more barbs 193 at an end thereof.

In some embodiments, the coils of the spring 136 wrapped around the post 153 past the barbs 193 undergo some amount of compression or expansion during use when the spring-biased end cap 130 is mounted. In certain configurations, the amount of compression or expansion of the coils of the spring 136 retained by the barbs 193 is less than the amount of compression or expansion of the coils of the intermediate portion 139 of the spring 136 that extend freely through the cavity 146. In some configurations, there is little or no compression or expansion of the coils that are past the barbs 193.

Anchoring or retaining the spring 136 on the post 153 in the above-described manner supports, stabilizes, and positions the spring 136, and allows the spring 136 to thereby support, stabilize, and position the inner body 134 and the outer rod 114. Specifically, the post 153 maintains the spring 136 along a central longitudinal axis L of the outer body 132 and in a position substantially perpendicular to the inboard end 142 and the outboard end 144 and the mounting surfaces. In addition, this configuration keeps the spring 136 and the inner body 134 from becoming dislodged from the outer body 132 or falling out in both use, storage, and transportation of the spring-biased end cap 130.

The outboard end 144 is open and defines a cavity 148. An annular wall 151 depends from the lateral wall 150 at the periphery of the lateral wall 150, extending into the cavity 148. An annular face 145 defined by the outer wall 140 at the outboard end 144 and an annular recess 156 outboard of and about the cavity 148 are shaped to engage a perimeter portion of a mounting pad 157. As illustrated, the mounting pad 157 may be coupled to or engage the annular face 145, the annular recess 156, and an end surface 152 of the annular wall 151. In some embodiments, the annular wall 151 includes a plurality of projections 152*a* (FIG. 22) extending axially and radially inwardly from the annular wall 151 and defining increased surface area at the end surface 152 for seating the mounting pad 157. The mounting pad 157 may be coupled to the above-noted portions of the outer body 132 by, for example, gluing or welding.

Figure 25:
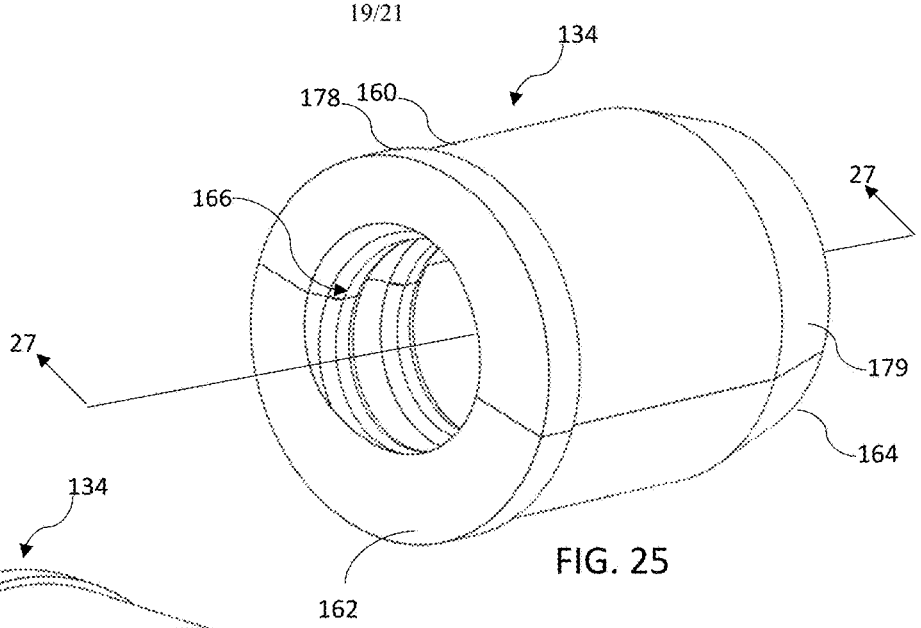
FIG. 25 is an outboard end perspective view of an inner body of the spring-biased end cap of FIG. 15.
Figure 26:
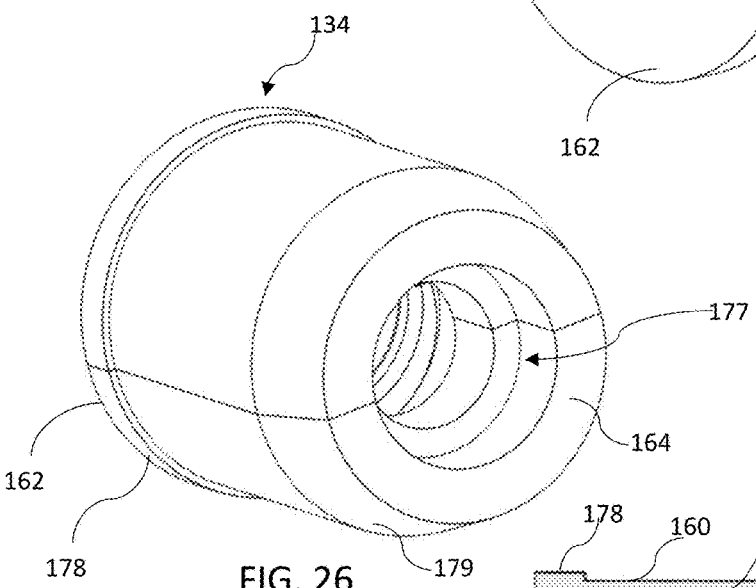
FIG. 26 is an inboard end perspective view of the inner body of FIG. 25.
Figure 27:
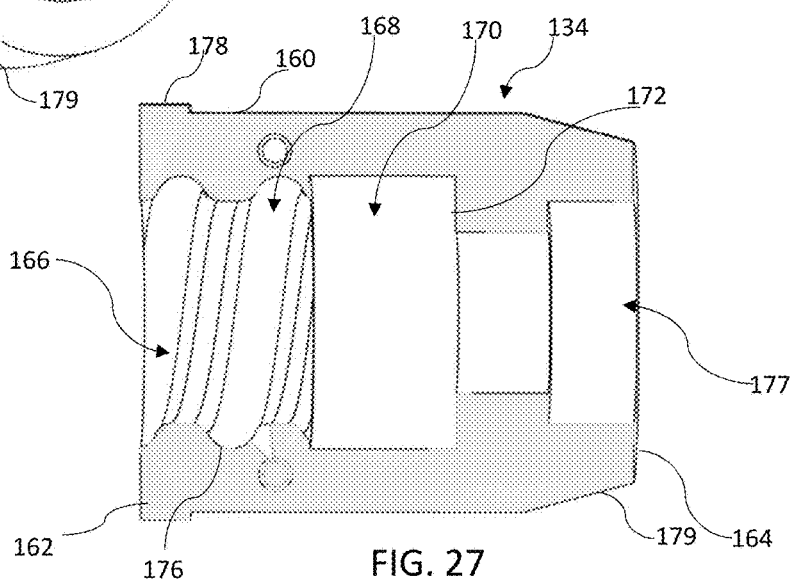
FIG. 27 is a cross-sectional view of the inner body of FIG. 25 taken along line 27-27 of FIG. 25.

With reference to FIGS. 25-27, the inner body 134 is substantially the same as inner body 34, including a passage 166 for receiving the second end portion 138 of the spring 136 and having an outer diameter sized to coaxially receive the outer rod 14 over the inner body 134 with a friction fit. Since the features of inner body 134 are like those of inner body 34, the description of the features of inner body 34 are incorporated by reference herein.

The spring-biased end cap 130 has a similar functionality and use as described above with respect to spring-biased end cap 30, and, thus, the above description of these aspects is also incorporated by reference herein.

The inner body 134 and the outer body 132 may have other configurations other than those illustrated and described above. Specifically, the inner body 134 and the outer body 132 may be configured differently with respect to how each element couples to or engages the spring 136. For instance, in some approaches, the spring 136 is anchored or coupled to both the inner body 134 and the outer body 132, as described above. In other approaches, the spring 136 may be anchored or coupled to only one of the inner body 134 or the outer body 132. For instance, the spring 136 may be secured to the outer body 132 (for example, via post 153 or threaded/grooved passage 52) but may not be secured to the inner body 134. Instead, for instance, the passage 166 of the inner body 134 may be open without any retaining features (e.g., grooves or threads), and the spring 136 coupled to the outer body 132 is simply inserted into the passage 166 of the inner body 134 during use.

In another approach, the spring 136 may be secured to the inner body 134 (for example, within a grooved or threaded passage 66), but may not be secured to the outer body 132. For instance, a passage (e.g., such as passage 52 described above) in the outer body 132 may not have any retaining features such as grooves or threading to secure the spring 136 to the outer body 132. The spring 136 may simply be inserted relatively loosely into such a passage (or, alternatively, with a slight friction fit). In some configurations, a post such as post 153 may be used, though without any retaining features such as barbs or hooks. The post may instead be used to center or position the spring 136 within the outer body 132 instead of to couple or secure the spring 136 to the outer body. In some approaches, the spring 136 may simply abut an inner wall of the outer body 132, with or without a positioning means. In these approaches in which the spring 136 is not secured to both the outer body 132 and the inner body 134, the outer body 132 may be relatively loose in relation to the inner body 134 and the rest of the rod assembly in an unmounted condition, though the components would be held together in tension in a mounted condition.

In embodiments, any of the spring-biased end caps described herein may be packaged so that the outer body, inner body, and spring are already coupled together. In other embodiments, the outer body and the spring are initially coupled together without being coupled to the inner body. The inner body is configured so that it couplable to the spring during installation and use of the end cap in a rod assembly by a user. In some cases, the inner body may already be inserted into the rod via a friction fit, and the method of installing the spring-biased end cap and rod assembly includes the user coupling the inner body already connected to the rod to the spring (e.g., by threading the spring into the inner body via internal threads disposed in the inner body or some other mechanism) to connect the inner body to the outer body. In some cases, the inner body is initially separate from both the outer body and the rod and the user makes the connections. In still another embodiment, the inner body and the spring may be initially coupled together (and, optionally, also attached to a rod) without being coupled to the outer body and the outer body is configured so that it is couplable to the spring during installation and use of the end cap (e.g., by threading the spring into the outer body or some other mechanism).

Figure 28:
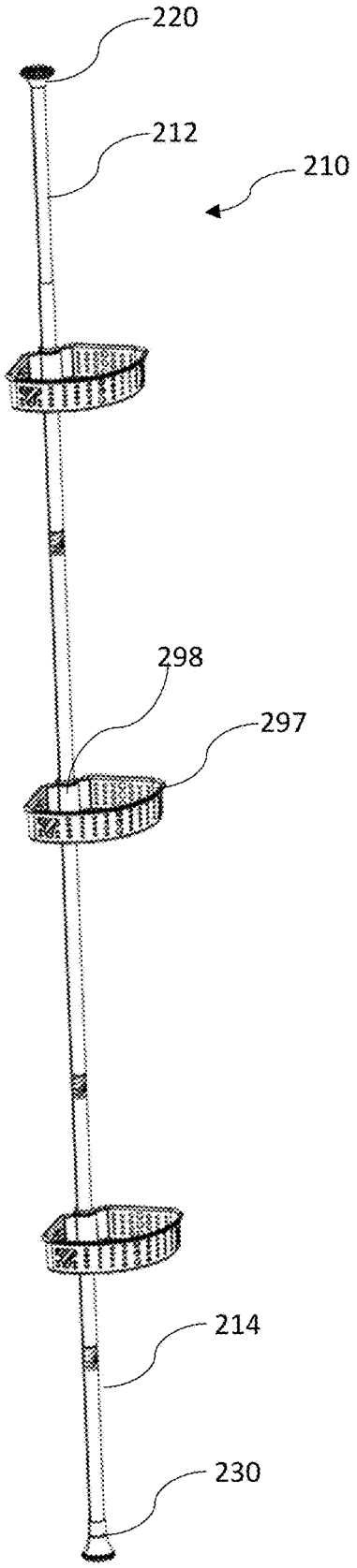
FIG. 28 is front perspective view of a rod assembly according to a third embodiment.

FIG. 28 illustrates another rod assembly 210. Many features of the rod assembly 210 are similar to those discussed above for the rod assembly 10. Common features are denoted with the same number except the number will begin with a "2" for the rod assembly 210. To the extent some of the common features are not specifically referenced in the description of rod assembly 210, the description of the same features present in rod assembly 10 are incorporated by reference.

The rod assembly 210 is a shower caddy that is mounted vertically (for example, from a floor to a ceiling). The rod assembly 210 includes a first end cap 220 and a second end cap 230, at least one outer rod 214, and at least one inner rod 212. In some embodiments, instead of an outer rod and an inner rod, there may be multiple rods that are the same diameter which are connected to each other via tapered ends of each rod.

One or more locks 298 may lock adjacent rods together at a desired combined length and/or support baskets 297. The locks 298 and baskets 297 may include the locks and baskets disclosed in U.S. Publication No. 2023/0277012 which is incorporated by reference herein in its entirety. Other locking mechanisms between the rods may also be used in the rod assembly 210, such as those described in U.S. Pat. Nos. 10,959,559 and 11,382,447, which both are incorporated by reference herein in their entireties.

The rod assembly 210 has at least one spring-biased end cap. In the illustrated embodiment, the first end cap 220 is a non-spring-biased end cap and the second end cap 230 is a spring-biased end cap. However, in some approaches both the first end cap 220 and the second end cap 230 may be spring-biased end caps.

The spring-biased end cap 230 may be the same as spring-biased end cap 30 or 130, described above, or include any of the variations described above. The rod assembly 210 having at least one spring-biased end cap 230 is installed and functions in the same manner as described above.

Figure 29:
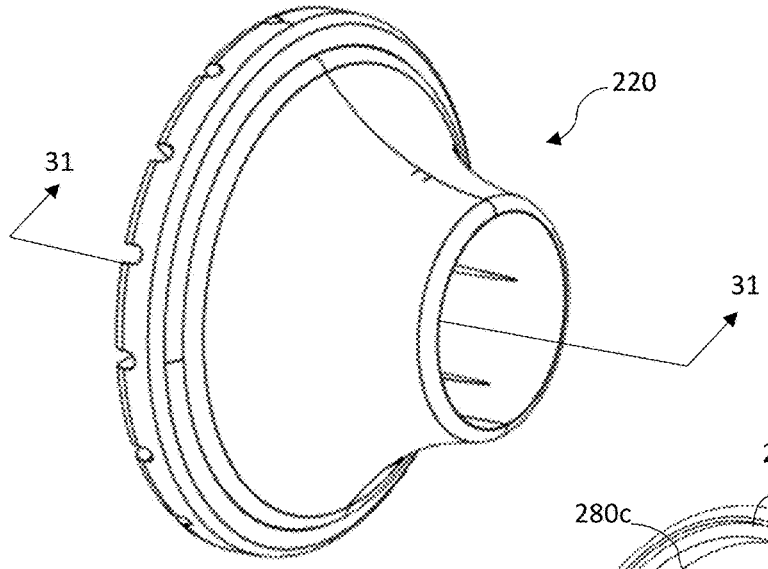
FIG. 29 is an inboard end perspective view of an end cap of the rod assembly of FIG. 28 that is not spring-biased.
Figure 30:
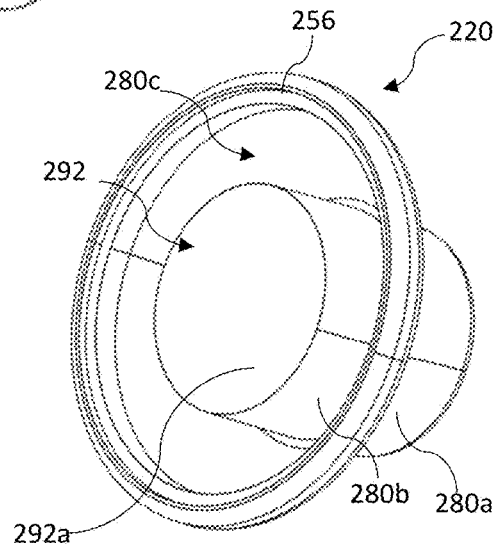
FIG. 30 is an outboard end perspective view of the end cap of FIG. 29.
Figure 31:
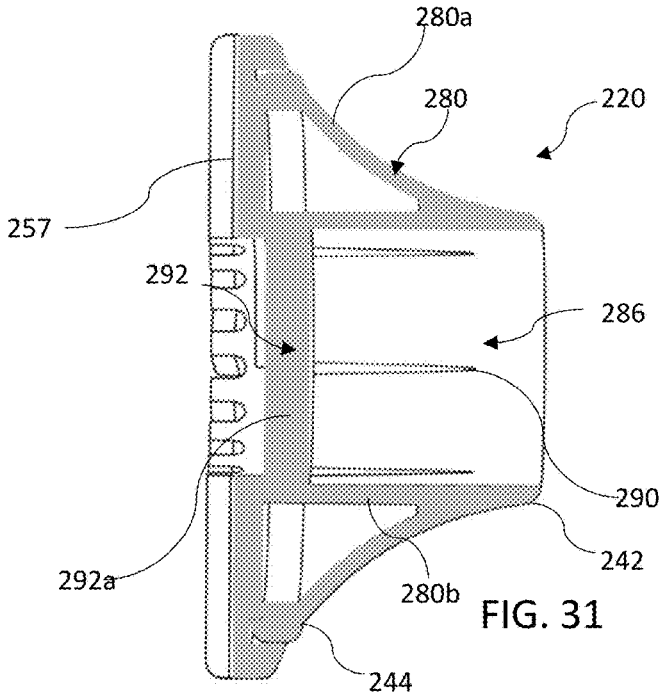
FIG. 31 is a cross-sectional view of the end cap of FIG. 29 taken along line 31-31 of FIG. 29.

With reference to FIGS. 29-31, the first end cap 220 is, in some embodiments, a non-spring-biased end cap. In the illustrated embodiment, the non-spring-biased end cap may include a body 280 having an outer annular wall 280*a* that is generally bell-shaped, having an outer diameter that gradually increases from an inboard end 242 of the body 280 to an outboard end 244. Other profiles, e.g., frustoconical, cylindrical, etc. are possible. An inner cup 292 is disposed radially inward of the outer annular wall 280*a*, defining an opening or cavity 286 for receiving one of the inner rod 212 or outer rod 214 with a friction fit. The inner cup 292 is defined in part by an inner annular wall 280*b* that has a first end that merges with the outer annular wall 280*a* adjacent the inboard end 242 of the main body 280 and a second end that extends concentrically within an outboard cavity 280*c* defined by the outer annular wall 280*a* at the outboard end 244. As illustrated, the inner cup 292 may be generally cylindrical, though other profiles are possible.

The cavity 286 of the end cap 220 may include one or more longitudinally extending tapered fins or ribs 290 to increase the friction fit force between the rod and the cavity 286. The end cap 220 may also include a mounting pad 257 similar to the mounting pads 57, 157 described above that is coupled to portions of the main body 280 at the outboard end 244, for example, at an annular recess 256 and/or at an outboard surface 292*a* of the inner cup 292.

Other non-spring-biased end caps may also be used, such as, for example, the threaded and free-spinning end caps disclosed, for example, in U.S. Publication No. 2023/0277012 which is incorporated by reference herein in its entirety.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. An end cap for mounting a rod to a surface, the end cap comprising:

an outer body having an outboard end for engaging a surface and an inboard end defining an opening and a first cavity for receiving a rod;

an inner body capable of being received at least in part within the first cavity; and a spring having a first end portion sized to be connected to the outer body and a second end portion sized to be connected to the inner body to connect the outer body to the inner body, the spring further having an intermediate portion configured to change a relative displacement between the inner body and the outer body upon compression or expansion of the spring, wherein the first end portion of the spring is sized to be connected to the outer body with an engagement with a post of the outer body projecting into the first cavity of the outer body such that the engagement resists disengagement of the spring from the post.

2. The end cap of claim 1, wherein the first end portion of the spring is wrapped around the post and the post includes a plurality of barbs that prevent the spring from falling off the post.

3. The end cap of claim 2, wherein each of the plurality of barbs include an angled side surface, and the angled side surfaces of the plurality of barbs are positioned relative to one another corresponding to a pitch of the spring.

4. The end cap of claim 1, wherein the post comprises a plurality of fingers, each of the fingers including a barb to prevent the spring from separating from the post.

5. The end cap of claim 1, wherein the second end portion is capable of being connected to the inner body by engaging one or more grooves in a passage of the inner body.

6. The end cap of claim 5, wherein the one or more grooves define threading of the passage that is capable of engaging one or more coils of the second end portion of the spring.

7. An end cap for mounting a rod to a surface, the end cap comprising:

an outer body having an outboard end for engaging a surface and an inboard end defining an opening and a first cavity for receiving a rod;

an inner body capable of being received at least in part within the first cavity; and a spring having a first end portion sized to be connected to the outer body and a second end portion capable of being connected to the inner body to connect the outer body to the inner body, the spring further having an intermediate portion configured to change a relative displacement between the inner body and the outer body upon compression or expansion of the spring, wherein the second end portion is capable of being connected to the inner body by engaging one or more grooves in a passage of the inner body, wherein the passage includes a first portion containing the one or more grooves and a second portion without grooves that is capable of receiving one or more terminal coils of the spring.

8. The end cap of claim 1, wherein the first end portion of the spring is connected to the outer body by engaging one or more grooves in a passage of the outer body.

9. The end cap of claim 1, wherein the inner body includes an outer wall having a first end section that is substantially cylindrical and a second end section that is substantially frustoconical.

10. A rod assembly comprising:

a first rod and a second rod that are adjustable relative to one another to adjust a total length of the rod assembly along a longitudinal axis; and a first end cap and a second end cap attachable to the first rod and the second rod, the first end cap including an outer body, an inner body, and a spring couplable to both the outer body and the inner body to allow movement of the inner body relative to the outer body along the longitudinal axis upon compression or expansion of the spring, wherein a first end portion of the spring is sized to be coupled to the outer body by engaging a post of the outer body projecting into a first cavity of the outer body, the post having a leading edge that is angled.

11. The rod assembly of claim 10, wherein at least one of the outer body and the inner body includes one or more grooves for coupling the spring to the first end cap.

12. The rod assembly of claim 10, wherein the inner body includes a passage having a first section including threading and a second non-threaded section, both the first section and the second non-threaded section being configured to receive a portion of the spring within the inner body.

13. The rod assembly of claim 10, wherein the outer body has an outboard end for engaging a mounting surface and an inboard end having an opening defining the first cavity for receiving the first rod or the second rod, the inner body being movable within the first cavity via the spring, and wherein the first rod or the second rod is sized to receive and engage the inner body in a friction fit so that the first rod or the second rod is movable with the inner body.

14. An end cap for mounting a rod to a surface, the end cap comprising:

an outer body having an outboard end for engaging a surface and an inboard end for receiving a rod, the outboard end comprising a first cavity and a cylindrical wall projecting within the first cavity, the inboard end defining an opening and a second cavity for receiving the rod;

an inner body capable of being received at least in part within the second cavity; and a spring having a first end portion sized to be connected to the outer body and a second end portion capable of being connected to the inner body to connect the outer body to the inner body, the spring further having an intermediate portion configured to change a relative displacement between the inner body and the outer body upon compression or expansion of the spring.

15. The end cap of claim 14, the outer body comprising an inner wall that defines a bottom of the first cavity and a bottom of the second cavity, the cylindrical wall projecting into the first cavity perpendicularly from the inner wall.

* * * * *